US008662609B2

(12) United States Patent
Miwa

(10) Patent No.: US 8,662,609 B2
(45) Date of Patent: Mar. 4, 2014

(54) IMAGE FORMING APPARATUS INCLUDING RECORDING HEAD FOR EJECTING LIQUID DROPLETS

(75) Inventor: Atsushi Miwa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/601,943

(22) Filed: Aug. 31, 2012

(65) Prior Publication Data

US 2013/0057605 A1 Mar. 7, 2013

(30) Foreign Application Priority Data

Sep. 7, 2011 (JP) ..... 2011-194613
Dec. 2, 2011 (JP) ..... 2011-265305
Aug. 10, 2012 (JP) ..... 2012-177760

(51) Int. Cl.
*B41J 29/38* (2006.01)

(52) U.S. Cl.
USPC ..... 347/6; 347/84; 347/85

(58) Field of Classification Search
USPC ..... 347/6, 7, 14, 19, 84–87
See application file for complete search history.

(56) References Cited

U.S. PATENT DOCUMENTS 7,077,513 B2 * 7/2006 Kimura et al. ..... 347/85
7,651,184 B2 * 1/2010 Nakamura et al. ..... 347/6

FOREIGN PATENT DOCUMENTS

JP 2003-145802 5/2003
JP 2006-256229 9/2006
JP 2010-64464 3/2010

* cited by examiner

*Primary Examiner* — Juanita D Jackson
(74) *Attorney, Agent, or Firm* — Cooper & Dunham LLP

(57) ABSTRACT

An image forming apparatus includes an apparatus body, a recording head, head tanks, main tanks, liquid feed pumps, a first driving source, a drive control unit, and a drive switching assembly. The drive switching assembly includes a second driving source, a cam, a slider member, a switching gear, switching position detected portions, and a detector. The detected portions are disposed at the cam so as to correspond to switching positions of the liquid feed pumps. One of the detected portions has a greater width in a rotation direction of the cam than any other detected portion. When a time from when the detector detects one of the detected portions to when the detector detects another one of the detected portions is shorter than a threshold value, the drive control unit determines, as a home position, a position of the cam on detection of the another one with the detector.

6 Claims, 23 Drawing Sheets

(a)

| DRIVING TARGET | M | K | C | Y | M |
|---|---|---|---|---|---|
| CAM ANGLE | 0 | 90 | 180 | 270 | 360 |
| NUMBER OF REQUIRED PULSE FROM HP | 0 | 90 | 180 | 270 | 360 |

(b)

(a)

| DRIVING TARGET | M | K | C | Y | M |
|---|---|---|---|---|---|
| CAM ANGLE | 0 | 90 | 180 | 270 | 360 |
| NUMBER OF REQUIRED PULSE FROM HP | 0 | 90 | 180 | 270 | 360 |

(a)

| DRIVING TARGET | MAINTE-NANCE | M | K | AIR RELEASE | C | Y | MAINTE-NANCE |
|---|---|---|---|---|---|---|---|
| CAM ANGLE | 0 | 60 | 120 | 180 | 240 | 300 | 360 |
| NUMBER OF REQUIRED PULSE FROM HP | 0 | 60 | 120 | 180 | 240 | 300 | 360 |

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application Nos. 2011-194613, filed on Sep. 7, 2011, 2011-265305, filed on Dec. 2, 2011, and 2012-177760, filed on Aug. 10, 2012 in the Japan Patent Office, the entire disclosure of each of which is hereby incorporated by reference herein.

BACKGROUND

1. Technical Field

This disclosure relates to an image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink.

Such an image forming apparatus may have, for example, replaceable main tanks (ink cartridges) and head tanks. The main tanks store different color inks to be supplied to one or more recording heads for ejecting ink droplets of different colors. The head tanks dedicated for the respective color inks receive the color inks from the main tanks and supply the inks to the recording heads.

Such an image forming apparatus may also have a maintenance unit (maintenance-and-recovery unit) to maintain and recover the performance of the recording heads. The maintenance unit typically has suction caps to cover the nozzle faces of the recording heads and a suction pump connected to the suction caps to suck ink from nozzles of the recording heads.

Furthermore, such an image forming apparatus may have an air release unit and an air release driving unit. The air release unit is disposed at the head tank and openable to release air from the interior of the head tank to the atmosphere. The air release driving unit is disposed at an apparatus body to drive the air release unit.

In a case where such an image forming apparatus has multiple pumps, such as liquid feed pumps and the suction pump, if multiple driving motors are provided as driving, sources dedicated for the respective pumps, the size and cost of the image forming apparatus increases.

Hence, for example, JP-2003-145802-A proposes an image forming apparatus having a sun gear, a planet gear, pump driving gears, and a revolution regulation unit to selectively drive three or more pumps with a single driving source. The sun gear is rotated in first and second directions by the rotation drive force of a selective driving mechanism. The planet gear revolves around the sun gear with rotation of the sun gear and rotates on its axis with rotation of the sun gear when the revolution is restricted. The pump driving gears are arranged along the revolution trajectory of the planet gear to in turn engage the planet gear when the planet gear revolves with the rotation of the sun gear in the first direction. The revolution regulation unit restricts the revolution of the planet gear performed with the rotation of the sun gear in the second direction, at positions where the planet gear engages the pump driving gears.

However, the above-described configuration poses difficulties in activating the pumps independent of one another, as compared to a configuration in which dedicated driving sources for the respective pumps are employed. In addition, since the driving (rotation) direction of the pumps is limited to one direction, the above-described configuration has difficulties in being applied to, e.g., a case where liquid feed pumps for feeding liquid in both directions are used.

BRIEF SUMMARY

In an aspect of this disclosure, there is provided an image forming apparatus including an apparatus body, a recording head, a plurality of head tanks, a plurality of main tanks, a plurality of liquid feed pumps, a first driving source, a drive control unit, and a drive switching assembly. The recording head ejects droplets of liquids. The plurality of head tanks supplies the liquids to the recording head. The plurality of main tanks is removably mounted in the apparatus body to store the liquids to be supplied to the recording head. The plurality of liquid feed pumps feeds the liquids from the plurality of main tanks to the plurality of head tanks and in reverse from the plurality of head tanks to the plurality of main tanks. The first driving source drives the plurality of liquid feed pumps. The drive control unit controls driving of the first driving source. The drive switching assembly selectively transmits a driving force of the first driving source to the plurality of liquid feed pumps. The drive switching assembly includes a second driving source, a cam, a slider member, a switching gear, a plurality of switching position detected portions, and a detector. The second driving source is controlled by the drive control unit. The cam is rotated by the second driving source. The slider member is movable in a thrust direction with rotation of the cam. The switching gear receives the driving force of the first driving source and is movable with the slider member between positions to engage driving gears of the plurality of liquid feed pumps and a position to disengage from the driving gears of the plurality of liquid feed pumps. With movement of the switching gear, the driving force of the first driving source is selectively transmitted to the plurality of liquid feed pumps. The plurality of switching position detected portions is disposed at the cam so as to correspond to switching positions of the plurality of liquid feed pumps. One of the plurality of switching position detected portions has a greater width in a rotation direction of the cam than a width of any of the others of the plurality of switching position detected portions. The detector detects the plurality of switching position detected portions. When a time from when the detector detects one of the plurality of switching position detected portions to when the detector detects another one of the plurality of switching position detected portions is shorter than a threshold value, the drive control unit determines, as a home position, a position of the cam on detection of the another one of the plurality of switching position detected portions with the detector.

In another aspect of this disclosure, there is provided an image forming apparatus including an apparatus body, a recording head, a plurality of head tanks, a plurality of main tanks, a plurality of liquid feed pumps, a first driving source, a drive control unit, and a drive switching assembly. The recording head ejects droplets of liquids. The plurality of head tanks supplies the liquids to the recording head. The plurality of main tanks is removably mounted in the apparatus body to store the liquids to be supplied to the recording head.

The plurality of liquid feed pumps feeds the liquids from the plurality of main tanks to the plurality of head tanks and in reverse from the plurality of head tanks to the plurality of main tanks. The first driving source drives the plurality of liquid feed pumps. The drive control unit controls driving of the first driving source. The drive switching assembly selectively transmits a driving force of the first driving source to the plurality of liquid feed pumps. The drive switching assembly includes a second driving source, a cam, a rotary member, a slider member, a switching gear, a plurality of switching position detected portions, and a detector. The second driving source is controlled by the drive control unit. The cam is rotated by the second driving source. The rotary member is rotatable with the cam. The slider member is movable in a thrust direction with rotation of the cam. The switching gear receives the driving force of the first driving source and is movable with the slider member between positions to engage driving gears of the plurality of liquid feed pumps and a position to disengage from the driving gears of the plurality of liquid feed pumps. With movement of the switching gear, the driving force of the first driving source is selectively transmitted to the plurality of liquid feed pumps. The plurality of switching position detected portions is disposed at the rotary member so as to correspond to switching positions of the plurality of liquid feed pumps. One of the plurality of switching position detected portions has a greater width in a rotation direction of the rotary member than a width of any of the others of the plurality of switching position detected portions. The detector detects the plurality of switching position detected portions. When a time from when the detector detects one of the plurality of switching position detected portions to when the detector detects another one of the plurality of switching position detected portions is shorter than a threshold value, the drive control unit determines, as a home position, a position of the cam on detection of the another one of the plurality of switching position detected portions with the detector.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
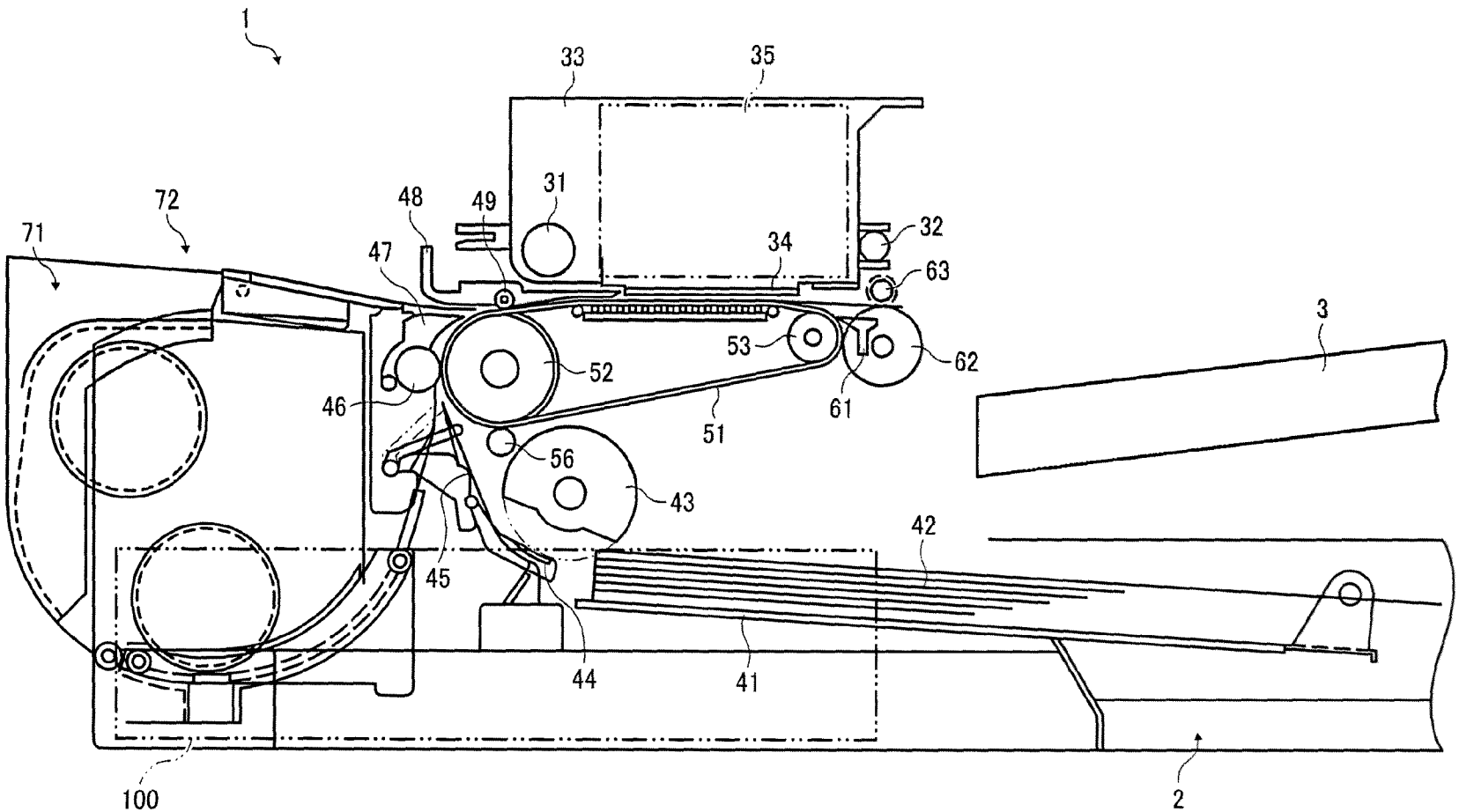
FIG. 1 is a schematic side view of a mechanical section of an image forming apparatus according to a first exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

In this disclosure, the term "sheet" used herein is not limited to a sheet of paper but includes, e.g., an OHP (overhead projector) sheet, a cloth sheet, a grass sheet, a substrate, or anything on which droplets of ink or other liquid can adhere. In other words, the term "sheet" is used as a generic term including a recording medium, a recorded medium, a recording sheet, or a recording sheet of paper. The term "image forming apparatus" refers to an apparatus that ejects ink or any other liquid onto a medium to form images on the medium. The medium is made of, for example, paper, string, fiber, cloth, leather, metal, plastic, glass, timber, and ceramic. The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "ink" as used herein is not limited to "ink" in a narrow sense unless specifically distinguished and includes any types of liquid useable for image formation, such as recording liquid, fixing solution, DNA sample, resist, pattern material, and resin.

The term "image" used herein is not limited to a two-dimensional image and includes, for example, an image applied to a three dimensional object and a three dimensional object itself formed as a three-dimensionally molded image.

The term "image forming apparatus" includes e.g., both a serial-type image forming apparatus and a line type image forming apparatus.

Referring now to the drawings, wherein like reference numerals designate identical or corresponding parts throughout the several views, exemplary embodiments of the present disclosure are described below.

First, an image forming apparatus according to a first exemplary embodiment of this disclosure is described with reference to FIGS. 1 and 2.

FIG. 1 is a side view of an entire configuration of the image forming apparatus. FIG. 2 is a partial plan view of the image forming apparatus.

In this first exemplary embodiment, the image forming apparatus is described as a serial-type inkjet recording apparatus. It is to be noted that the image forming apparatus is not limited to such a serial-type inkjet recording apparatus and may be any other type image forming apparatus. In the image forming apparatus, a carriage 33 is supported on a main guide rod 31 and a sub guide rod 32 so as to be movable in a direction (main scanning direction) indicated by an arrow MSD in FIG. 2. The main guide rod 32 and the sub guide rod 33 serving as guide members extend between a left-side plate 21A and a right-side plate 21B standing on an apparatus body 1. The carriage 33 is reciprocally moved in the main scanning direction by a main scanning motor and a timing belt.

The carriage 33 mounts recording heads 34*a* and 34*b* (collectively referred to as "recording heads 34" unless distinguished) serving as liquid ejection heads for ejecting ink droplets of different colors, e.g., yellow (Y), cyan (C), magenta (M), and black (K). The recording heads 34*a* and 34*h* are mounted on the carriage 33 so that nozzle rows, each of which includes multiple nozzles, are arranged in parallel to a direction (sub-scanning direction) perpendicular to the main scanning direction and ink droplets are ejected downward from the nozzles.

For example, each of the recording heads 34 has two nozzle rows. In such a case, for example, one of the nozzle rows of the recording head 34*a* ejects droplets of black (K) ink and the other ejects droplets of cyan (C) ink. In addition, one of the nozzle rows of the recording head 34*h* ejects droplets of magenta (M) ink and the other ejects droplets of yellow (Y) ink.

The carriage 33 also mounts head tanks 35*a* and 35*b* (collectively referred to as "head tanks 35" unless distinguished) for supplying the respective color inks to the corresponding nozzle rows. A liquid feed pump unit 24 supplies (replenishes) the respective color inks from ink cartridges 10Y, 10M, 10C, and 10K to the head tanks 35 via ink supply tubes 36 dedicated for the respective color inks. The ink cartridges 10Y, 10M, 10C, and 10K are removably mountable to a cartridge mount portion 4.

The image forming apparatus further includes a sheet feed section to feed sheets 42 stacked on a sheet stack portion (platen) 41 of a sheet feed tray 2. The sheet feed section includes a sheet feed roller 43 of, e.g., a half moon shape to separate the sheets 42 from the sheet stack portion 41 and feed the sheets 42 sheet by sheet, and a separation pad 44 disposed facing the sheet feed roller 43. The separation pad 44 is made of a material of a high friction coefficient and urged toward the sheet feed roller 43.

To feed the sheet 42 from the sheet feed section to an area below the recording heads 34, the image forming apparatus includes a first guide member 45 to guide the sheet 42, a counter roller 46, a conveyance guide member 47, a regulation member 48 including a front-end guide roller 49, and a conveyance belt 51 to convey the sheet 42 to a position facing the recording head 34 with the sheet 42 electrostatically adhered thereon.

Figure 2:
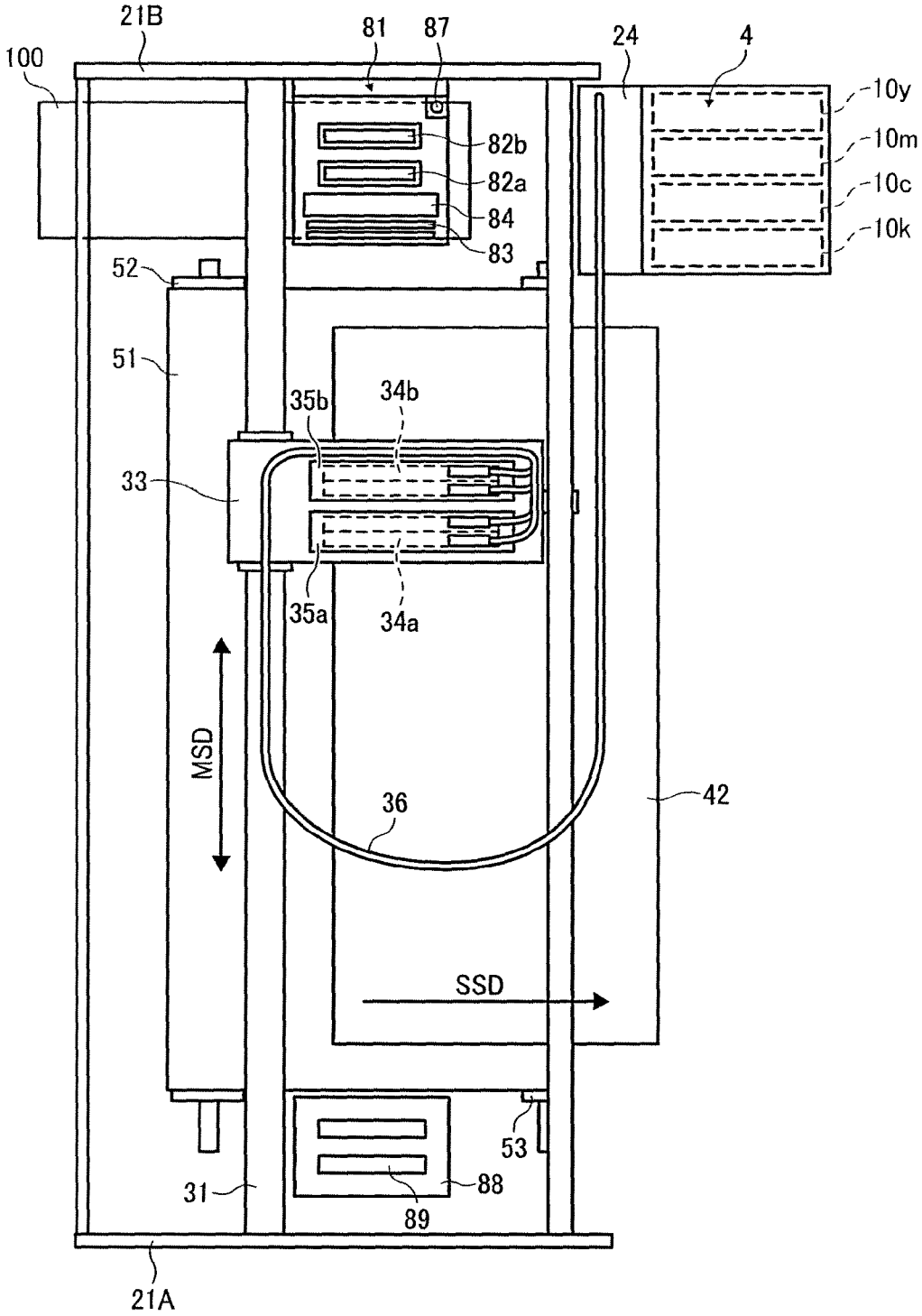
FIG. 2 is a plan view of the mechanical section of the image forming apparatus illustrated in FIG. 1.

The conveyance belt 51 is an endless belt that is looped between a conveyance roller 52 and a tension roller 53 so as to circulate in a belt conveyance direction, that is, the sub-scanning direction indicated by an arrow SSD in FIG. 2. A charging roller 56 is provided to charge a surface of the conveyance belt 51. The charging roller 56 is disposed so as to contact the surface of the conveyance belt 51 and rotate with the circulation of the conveyance belt 51. When the conveyance roller 52 is rotated by a sub-scanning motor via a timing roller, the conveyance belt 51 circulates in the sub-scanning direction SSD (belt conveyance direction) illustrated in FIG. 2.

The image forming apparatus further includes a sheet output section to output the sheet 42 on which an image has been formed by the recording heads 34. The sheet output section includes a separation claw 61 to separate the sheet 42 from the conveyance belt 51, a first output roller 62, a second output roller 63, and a sheet output tray 3 disposed below the first output roller 62.

A duplex unit 71 is removably mounted on a rear portion of the apparatus body 1. When the conveyance belt 51 rotates in reverse to return the sheet 42, the duplex unit 71 receives the sheet 42. Then the duplex unit 71 turns the sheet 42 upside down to feed the sheet 42 between the counter roller 46 and the conveyance belt 51. At the top face of the duplex unit 71 is formed a manual-feed tray 72.

As illustrated in FIG. 2, a maintenance unit 81 is disposed at a non-printing area (non-recording area) that is located on one end in the main scanning direction of the carriage 33. The maintenance unit 81 maintains and recovers nozzle conditions of the recording heads 34. The maintenance unit 81 includes caps 82*a* and 82*b* (hereinafter collectively referred to as "caps 82" unless distinguished) to cover the nozzle faces of the recording heads 34, a wiping member (wiper blade) 83 to wipe the nozzle faces of the recording heads 34, a first dummy ejection receptacle 84 to receive ink droplets ejected by dummy ejection in which ink droplets not contributing to image recording are ejected to remove viscosity-increased ink, and a carriage lock 87 to lock the carriage 33. Below the maintenance unit 81, a waste liquid tank 100 is removably mounted to the apparatus body 1 to store waste ink or liquid generated by the maintenance and recovery operation.

A second dummy ejection receptacle 88 is disposed at a non-recording area on the opposite end in the main-scanning direction of the carriage 33. The second dummy ejection receptacle 88 receives ink droplets ejected, e.g., during printing by dummy ejection in which ink droplets not contributing to image recording are ejected to remove viscosity-increased ink. The second dummy ejection receptacle 88 has openings 89 arranged in parallel to the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed between the conveyance belt 51 and the counter roller 46. Further, the front tip of the sheet 42 is guided with the conveyance guide member 47 and pressed against the conveyance belt 51 by the front-end guide roller 49 to turn the transport direction of the sheet 42 by approximately 90°.

At this time, alternating voltages are applied to the charging roller 56 so that plus outputs and minus outputs are alternately repeated. As a result, the conveyance belt 51 is charged with an alternating charged voltage pattern, that is, an alternating band pattern of positively-charged areas and negatively-charged areas in the sub-scanning direction SSD, i.e., the belt circulation direction. When the sheet 42 is fed onto the conveyance belt 51 alternately charged with positive and negative voltages, the sheet 42 is adhered on the conveyance belt 51 by electrostatic force and conveyed in the sub scanning direction by the circulation of the conveyance belt 51.

By driving the recording heads 34 in accordance with image signals while moving the carriage 33, ink droplets are ejected onto the sheet 42, which is stopped below the recording heads 34, to form one line of a desired image. Then, the sheet 42 is fed by a certain distance to prepare for the next operation to record another line of the image. Receiving a recording end signal or a signal indicating that the rear end of the sheet 42 has arrived at the recording area, the recording operation is finished and the sheet 42 is output to the sheet output tray 3.

To perform maintenance-and-recovery operation of the nozzles of the recording heads 34, the carriage 33 is moved to a home position at which the carriage 33 opposes the maintenance unit 81. Then, maintenance-and-recovery operation, such as nozzle sucking operation for sucking ink from nozzles with the nozzle faces of the recording heads 34 capped with the caps 82 and/or maintenance ejection for ejecting droplets of ink not contributed to image formation, is performed, thus allowing image formation with stable droplet ejection.

Next, an example of the head tank is described with reference to FIGS. 3 and 4.

Figure 3:
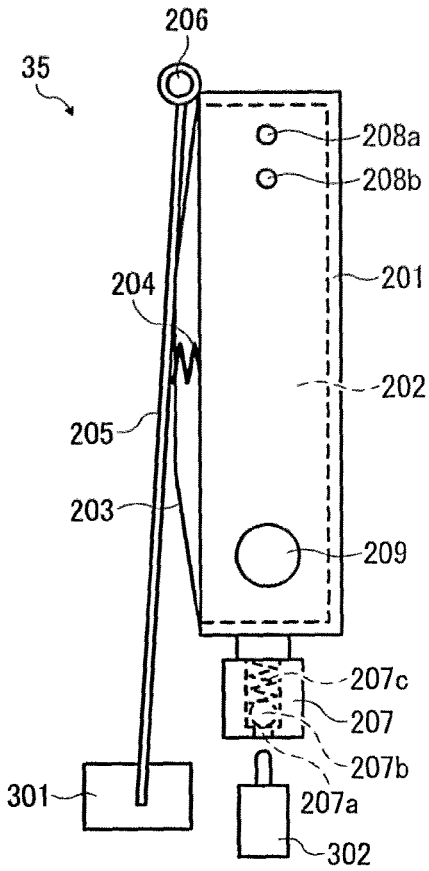
FIG. 3 is a schematic plan view of an example of a head tank of the image forming apparatus.
Figure 4:
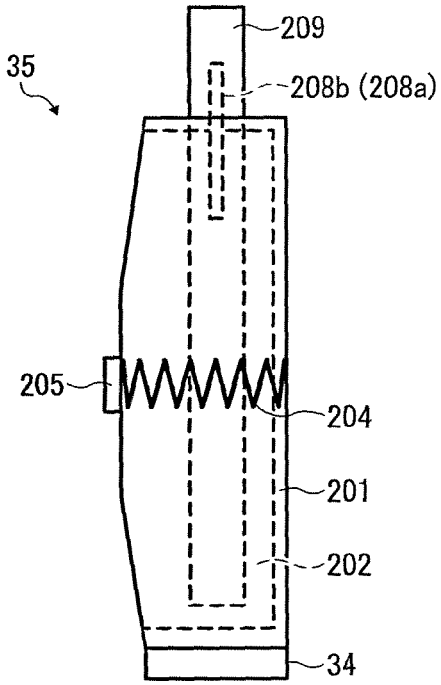
FIG. 4 is a schematic front view of the head tank illustrated in FIG. 3.

FIG. 3 is a schematic plan view of an example of the head tank 35. FIG. 4 is a schematic front view of the head tank 35 illustrated in FIG. 3.

The head tank 35 has a tank case 201 forming an ink accommodation part 202 to accommodate ink and having an opening at one side. The opening of the tank case 201 is sealed with a flexible film member 203, and a spring 204 serving as an elastic member is disposed in the tank case 201 to constantly urge the flexible film member 203 outward. Since the outward urging force of the spring 204 constantly acts on the flexible film member 203 of the tank case 201, a reduction in the remaining amount of ink in the tank case 201 creates a negative pressure in the tank case 201.

At the exterior of the tank case 201, a detection feeler 205 serving as a displacement member is fixed on the flexible film member 203 by e.g., adhesive. The detection feeler 205 has one end portion pivotably supported on a support shaft 206 and is urged toward the tank ease 201.

As a result, the detection feeler 205 displaces with the movement of the flexible film 203. The displacement amount of the detection feeler 205 is detected with a detection sensor 301 that is an optical sensor disposed at the main unit of the image forming apparatus, thus allowing detection of the remaining amount of ink in the head tank 35.

A supply port portion 209 is disposed at an upper portion of the tank case 201 and connected to the supply tube 36 to deliver ink from the ink cartridge 10 to the ink accommodation part 202. At a lateral side of the tank case 201 is disposed an air release unit 207 to release air from the interior of the head tank 35 to the atmosphere.

The air release unit 207 has an air release passage 207*a* communicating with the interior of the head tank 35, a valve body 207*b* to open and close the air release passage 207*a*, and a spring 207*c* to urge the valve body 207*b* into a closed state. An air release driving pin member 302 serving as an air release driving unit is disposed at the apparatus body 1, and the valve body 207*b* is pushed with the air release driving pin member 302 to open the air release passage 207*a*, thus causing the interior of the head tank 35 to be open to the atmosphere (in other words, causing the interior of the head tank 35 to communicate with the atmosphere).

Electrode pins 208*a* and 208*b* are mounted to the head tank 35 to detect the remaining amount of ink in the head tank 35. Because of the conductivity of ink, when ink arrives at the electrode pins 208*a* and 208*b*, electric current flows between the electrode pins 208*a* and 208*b*, thus causing a change in the resistance values of the electrode pins 208*a* and 208*b*. Such a configuration can detect that the liquid level of ink has decreased to a threshold level or lower, i.e., the amount of air in the head tank 35 has increased to a threshold amount or more, or the remaining amount of ink in the head tank 35 has decreased to a threshold amount or lower.

Next, an ink supply-and-discharge system of the image forming apparatus is described with reference to FIG. 5.

Figure 5:
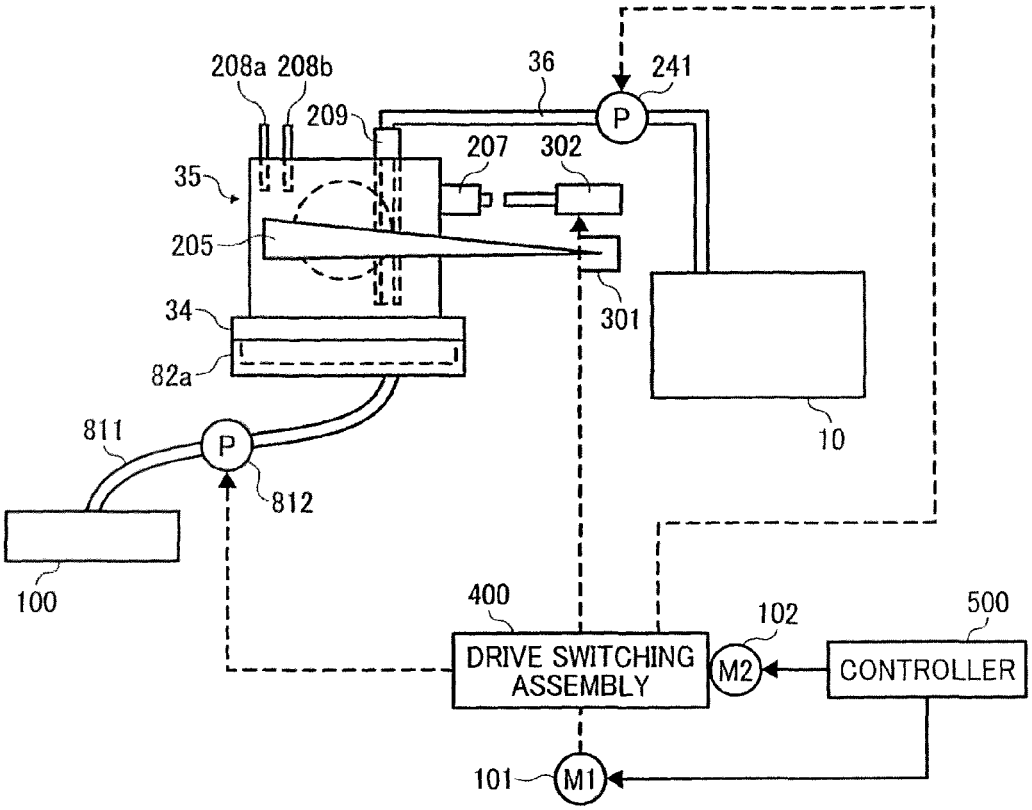
FIG. 5 is a schematic view of a supply-and-discharge system of the image forming apparatus.

In FIG. 5, an ink supply system connecting the ink cartridge to the head tank is illustrated for only one color for simplicity. However, it is to be noted that the ink supply system is provided for each of the other colors.

A liquid feed pump 241 serving as a liquid feed unit dedicated for each color is disposed in the liquid feed pump unit 24 to supply ink from the ink cartridge (main tank) 10 to the head tank 35 via the supply tube 36. The liquid feed pump 241 is a bidirectional pump, e.g., a tube pump, capable of performing normal feed operation to supply ink from the ink cartridge 10 to the head tank 35 and reverse feed operation to return ink from the head tank 35 to the ink cartridge 10.

The maintenance unit 81, as described above, has the cap 82*a* to cover the nozzle face of the recording head 34 and a suction pump 812 connected to the cap 82*a*. The suction pump 812 is driven with the nozzle face covered with the cap 82*a* to suck ink from the nozzles via a suction tube 811, thus allowing ink to be sucked from the head tank 35. The ink sucked from the head tank 35 is discharged as waste ink to the waste liquid tank 100.

At the apparatus body 1 of the image forming apparatus, the air release driving pin member 302 serving as an air release driving member (pressing member) is disposed to open and close the air release unit 207 of the head tank 35. By activating the air release driving pin member 302, the air release unit 207 can be opened. The detection sensor 301 serving as an optical sensor is disposed at the apparatus body 1 to detect the detection feeler 205.

The driving force of a first driving motor 101 (M1 in FIG. 5) serving as a first driving source is selectively transmitted to the liquid feed pumps 241 dedicated for the respective colors, the suction pump 812, and the air release driving pin member 302 via a drive switching assembly 400. The drive switching assembly 400 is driven with a second driving motor 102 (M2 in FIG. 5) serving as a second driving source (switching drive source). Driving of the first driving motor 101 is controlled with the controller 500.

Next, an example of a tube pump used as the liquid feed pump 241 and the suction pump 812 is described with reference to FIG. 6.

Figure 6:
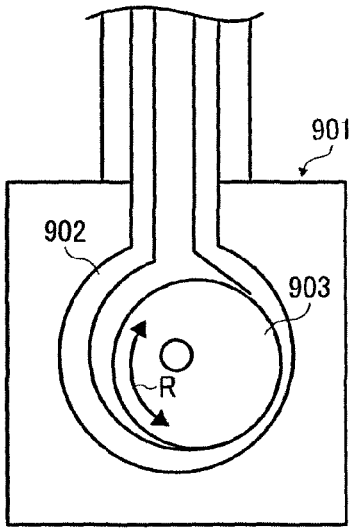
FIG. 6 is a schematic view of an example of a tube pump usable as a liquid feed pump and a suction pump of the image forming apparatus.

A tube pump 901 can transfer liquid through a tube 902 while compressing the tube 902 by an eccentric pressing roller 903 bidirectionally rotatable as indicated by an arrow R in FIG. 6.

In a case where the tube pump 901 is used as the liquid feed pump 241, rotating the pressing roller 903 in respective directions indicated by the arrow R allows ink to be fed from the ink cartridge 10 to the head tank 35 and in reverse from the head tank 35 to the ink cartridge 10. In a case where the tube pump 901 is used as the suction pump 812, rotating the pressing roller 903 in one direction allows ink to be sucked from the nozzles.

Next, an example of the controller of the image forming apparatus is described with reference to FIG. 7.

Figure 7:
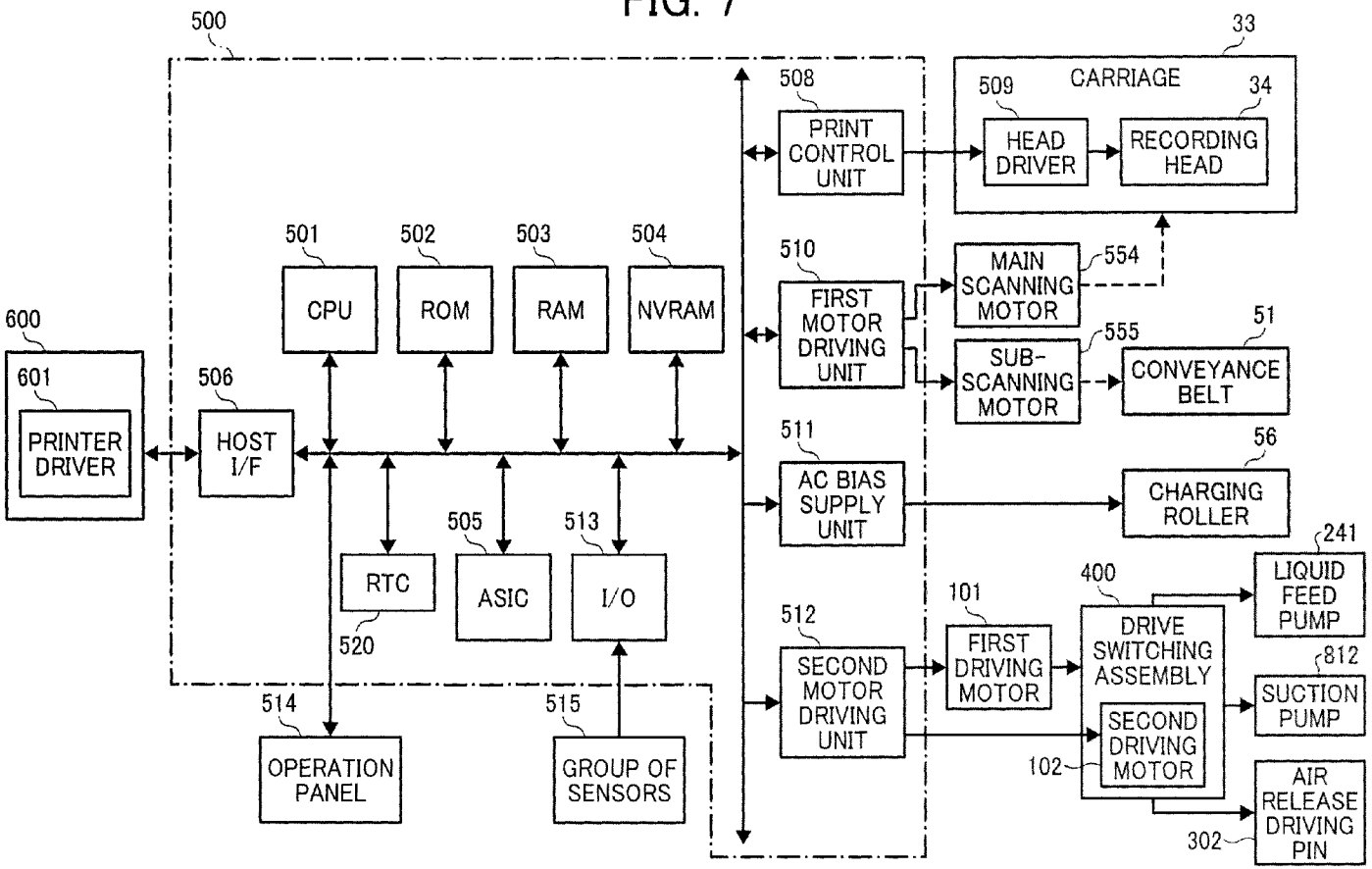
FIG. 7 is a schematic block diagram of a controller of the image forming apparatus.

FIG. 7 is a block diagram of an example of the controller 500 of the image forming apparatus. The controller 500 includes a central processing unit (CPU) 501, a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus and also serves as a motor drive control unit according to exemplary embodiments of this disclosure. The ROM 502 stores programs executed by the CPU 501 or other fixed data, and the RAM 503 temporarily stores image and other data. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub-scanning motor 555, a first motor driving unit 510, an alternating current (AC) bias supply unit 511, and a second motor driving unit 512. The print control unit 508 includes a data transfer section and a driving signal generating section to drive and control the recording heads 34. The head driver 509 is disposed at the carriage 33 to drive the recording heads 34. The main scanning motor 554 moves the carriage 33 for scanning, and the sub-scanning motor 555 circulates the conveyance belt 51. The first motor driving unit 510 drives the main scanning motor 554 and the sub-scanning motor 555. The AC bias supply unit 511 supplies an AC bias to the charging roller 56. The second motor driving unit 512 drives the first driving motor 101 and the second driving motor 102 of the drive switching assembly 400.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the host UP 506, performs desired image processing, data sorting, or other processing with the ASIC 505, and transfers image data to the head driver 509. It is to be noted that dot-pattern data for image output may be created by a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has a driving signal generating section including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses forming driving signals transmitted from the print control unit 508 and applies the selected driving pulses to driving elements (e.g., piezoelectric elements) to drive the recording heads 34. At this time, the driving elements serve as pressure generators to generate energy for ejecting liquid droplets from the recording heads 34. By selecting a part or all of the driving pulses forming the driving signals, the recording heads 34 can selectively eject different sizes of droplets, e.g., large droplets, medium droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the first motor driving unit 510, and the AC bias supply unit 511 based on the extracted information. The group of sensors 515 includes, for example, an optical sensor to detect the position of the sheet of recording media, a thermistor to monitor temperature and/or humidity in the apparatus, a voltage sensor to monitor the voltage of a charging belt, and an interlock switch to detect the opening and closing of a cover. The I/O unit 513 processes information from such various types of sensors. Additionally, information of the above-described electrode pins 208*a* and 208*b* and the detection sensor 301 to detect the detection feeler 205 of the head tank 35 are input to the I/O unit 513.

The controller 500 also has a timer 520 to measure time.

Next, a drive switching assembly in an exemplary embodiment of the present disclosure is described with reference to FIGS. 8 to 11.

Figure 8:
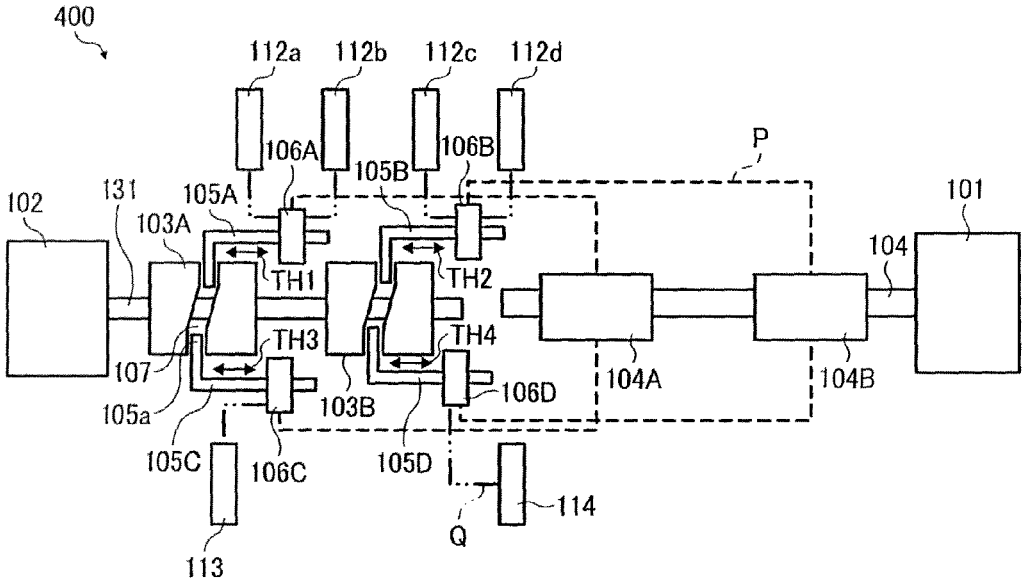
FIG. 8 is a schematic view of a drive switching assembly in an exemplary embodiment of this disclosure.
Figure 9:
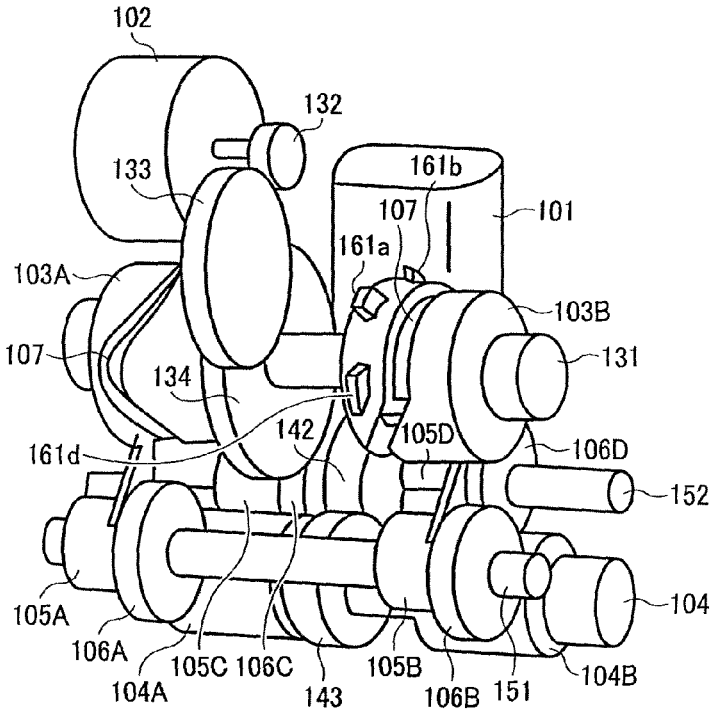
FIG. 9 is a perspective view of the drive switching assembly of FIG. 8.
Figure 10:
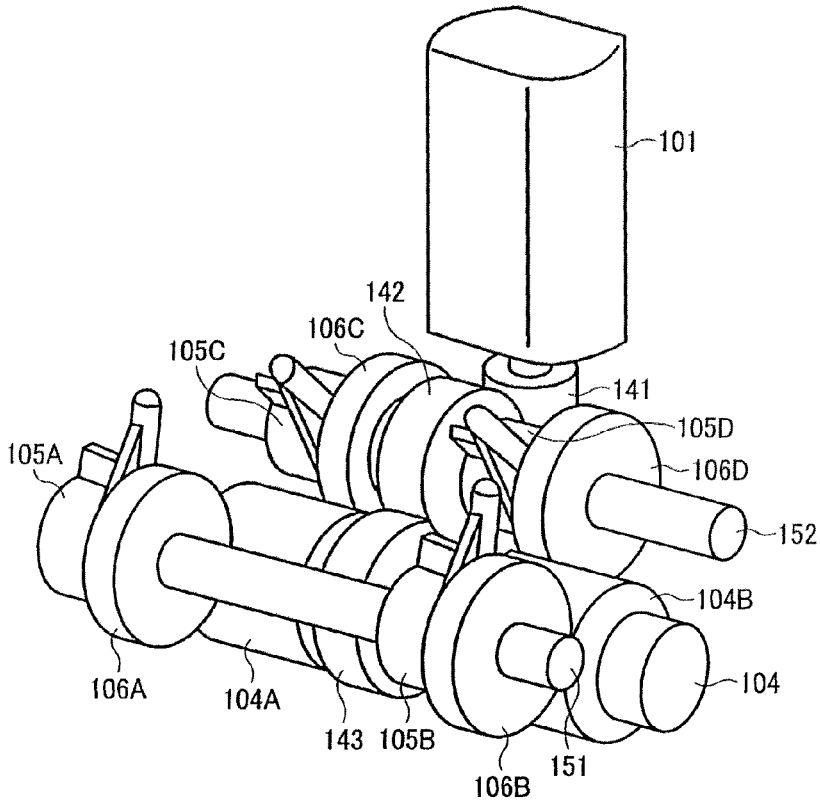
FIG. 10 is a perspective view of the drive switching assembly from which a cam section is removed for ease of view.
Figure 11:
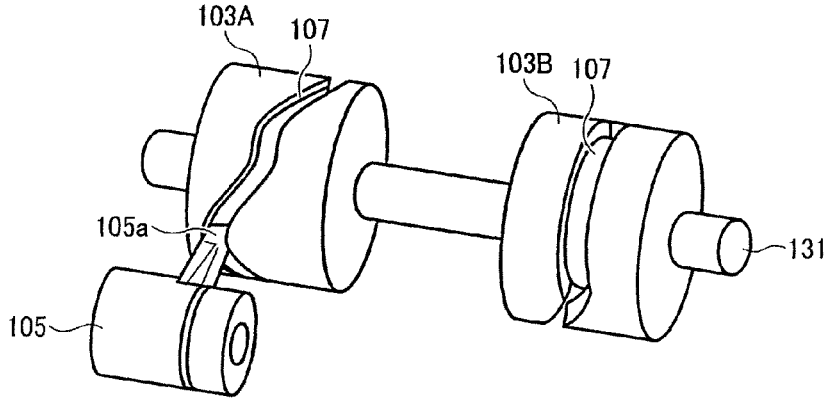
FIG. 11 is a perspective view of cams and a slider member of the drive switching assembly.

FIG. 8 is a schematic view of the drive switching assembly in this exemplary embodiment. FIG. 9 is a perspective view of the drive switching assembly. FIG. 10 is a perspective view of the drive switching assembly from which a cam section is removed for ease of view. FIG. 11 is a perspective view of cams and a slider member. In FIG. 8, broken lines P indicate a relationship in which two gears constantly engage with each other, and chain double-dashed lines Q indicate a relationship in which two gears detachably engage with each other. The same goes for the following drawings.

In the drive switching assembly 400, gears 104A and 104B are mounted on a driving shaft 104 rotated by the first driving motor 101.

The second driving motor 102 of the drive switching assembly 400 is formed of a stepping motor. Switching cams 103A and 103B (hereinafter, referred to as "switching cams 103" or simply "cams 103" unless distinguished) are mounted on a cam shaft 131 rotated by the second driving motor 102 of the drive switching assembly 400. Each of the cams 103A and 103B has a cam groove 107.

The drive switching assembly 400 also has slider members 105A to 105D (hereinafter, referred to as "slider members 105" unless distinguished). Each of the slider members 105A to 105D has an engagement portion 105*a* to engage the cam groove 107 of the cam 103A or 103B and is moved along a thrust direction indicated by each of arrows TH1 to TH4 in FIG. 8 with rotation of the cam 103A or 103B.

In FIG. 8, the engagement portions 105*a* of the slider members 105 are detached from the cam grooves 107 of the cams 103 for ease of view. However, actually, as described above, the engagement portions 105*a* of the slider members 105 slidably contact the cam grooves 107 of the cams 103.

On the slider member 105A is rotatably mounted a switching gear 106A that engages the gear 104A rotated by the first driving motor 101. On the slider member 105B is rotatably mounted a switching gear 1068 that engages the gear 1048 rotated by the first driving motor 101.

On the slider member 105C is rotatably mounted a switching gear 106C that engages the gear 104A rotated by the first driving motor 101. On the slider member 105D is rotatably mounted a switching gear 106D that engages the gear 104B rotated by the first driving motor 101.

Movement of the slider member 105A causes the switching gear 106A to move between an engagement position to engage either a driving gear 112*a* of a liquid feed pump 241 for, e.g., a first color or a driving gear 112*b* of a liquid feed pump 241 for, e.g., a second color and a disengagement (separate) position to disengage (separate) from any of the driving gears 112*a* and 112*b*.

Movement of the slider member 105B causes the switching gear 106B to move between an engagement position to engage either a driving gear 112*c* of a liquid feed pump 241 for, e.g., a third color or a driving gear 112*d* of a liquid feed pump 241 for, e.g., a fourth color and a disengagement (separate) position to disengage (separate) from any of the driving gears 112*c* and 112*d*.

Movement of the slider member 105C causes the switching gear 106C to move between an engagement position to engage a driving gear 113 of the suction pump 812 of the maintenance unit 81 and a disengagement (separate) position to disengage (separate) from the driving gear 113.

Movement of the slider member 105D causes the switching gear 106D to move between an engagement position to engage a driving gear 114 for reciprocally moving the air release driving pin member 302 and a disengagement (separate) position to disengage (separate) from the driving gear 114.

In this exemplary embodiment, each of the switching gears 106A and 106B serves as a first switching gear, the switching gear 1060 serves as a second switching gear, and the switching gear 106D serves as a third switching gear. The first to fourth colors of inks supplied from the four liquid feed pumps 241 are, e.g., black, cyan, magenta, and yellow.

In the configuration illustrated in FIGS. 9 to 11, the driving force of the first driving motor 101 is transmitted to the driving shaft 104 via a motor gear 141, a gear 142 rotatably mounted on a support shaft 152, and a gear 143 fixed on the driving shaft 104. The driving force of the second driving motor 102 serving as a switching drive source is transmitted to the cam shaft 131 via a motor gear 132, a gear 133, and a gear 134 fixed on the cam shaft 131. The slider member 105A, the switching gear 106A, the slider member 105B, and the switching gear 1068 are movably supported on a support shaft 151. The slider member 105C, the switching gear 106C, the slider member 105D, and the switching gear 106D are movably supported on a support shaft 152.

For such a configuration, driving the first driving motor 101 causes the driving force to be transmitted to the first switching gears 106A and 106B, the second switching gear 106C, and the third switching gear 106D via the gears 104A and 104B, thus rotating the switching gears 106A to 106D.

When the cams 103A and 103E are rotated by driving the second driving motor 102, the slider members 105A to 105D move along the respective directions indicated by the arrows TH1 to TH4 in FIG. 8 and the first switching gears 106A and 106B, the second switching gear 106C, and the third switching gear 106D also move along the respective directions indicated by the arrows TH1 to TH4 in FIG. 8.

When the first switching gear 106A moves to the position to engage the driving gear 112*a*, the liquid feed pump 241 for the first color is driven. Likewise, when the first switching gear 106A moves to the position to engage the driving gear 106B, the liquid feed pump 241 for the second color is driven.

When the slider member 105B moves along the direction indicated by the arrow D2 and the first switching gear 106B moves to the position to engage the driving gear 112*c*, the liquid feed pump 241 for the third color is driven. Likewise, when the first switching gear 106B moves to the position to engage the driving gear 112*d*, the liquid feed pump 241 for the fourth color is driven.

When the slider member 105C moves along the direction indicated by the arrow D3 and the second switching gear 106C moves to the position to engage the driving gear 113, the suction pump 812 of the maintenance unit 81 is driven.

When the slider member 105D moves along the direction indicated by the arrow D4 and the third switching gear 106D moves to the position to engage the driving gear 114, the air release driving pin member 302 is driven for reciprocal movement.

For such a configuration, as the first driving motor 101 rotates in any of clockwise and counterclockwise directions, the driving force of the first driving motor 101 is transmitted to the liquid feed pumps 241, thus allowing the liquid feed pumps 241 to be driven in any of the normal feed direction (normal rotation direction) and the reverse feed direction (reverse rotation direction).

It is to be noted that the configuration of the drive switching assembly is not limited to the above-described configuration. For example, by adjusting the phases of the cam grooves 107 of the cams 103A and 103B or connecting a plurality of slider members 105 to the cams 103A and 103B at different phases, the switching gears 106A to 106B may be switched in turn with rotation of the cams 103A and 103B or, by contrast, may be simultaneously coupled with a plurality of driving gears.

Using a plurality of cams (in this example, two cams) can reduce the distance at which one cam moves the switching gear, thus resulting in a reduced diameter of the cam. Additionally, using the plurality of cams allows, for example, five or more switching gears to be arranged in the thrust direction (axial direction) without changing dimensions in directions other than the thrust direction.

As described above, the image forming apparatus according to this exemplary embodiment includes a first driving source to drive a plurality of liquid feed pumps and a drive switching assembly to selectively transmit the driving force of the first driving source to the plurality of liquid feed pumps. The drive switching assembly has a second driving source, cams rotated by the second driving source, slider members moved along the thrust direction with rotation of the cams, and first switching gears that receives the driving force of the first driving source and is moved between engagement positions to engage driving gears of the plurality of liquid feed pumps and a disengagement position to disengage from any of the driving gears. By moving the first switching gears, the driving force of the first driving source is selectively transmitted to the plurality of liquid feed pumps. Since the driving source of the pumps is separated from the driving force of the drive switching assembly, such a configuration allows the plurality of pumps to be driven by a small number of driving sources with a relatively high degree of freedom.

In other words, use of the drive switching assembly according to this exemplary embodiment allows the normal and reverse rotation of the first driving source to be transmitted independent of the driving gears of other pumps and units. Thus, as with a configuration in which a single driving source is used, use of the drive switching assembly allows relatively free operation without constraints from other pumps and units.

Next, an example of driving control of a second driving source of a drive switching assembly according to an exemplary embodiment of the present disclosure is described with reference to FIGS. 12 to 14.

Figure 12:
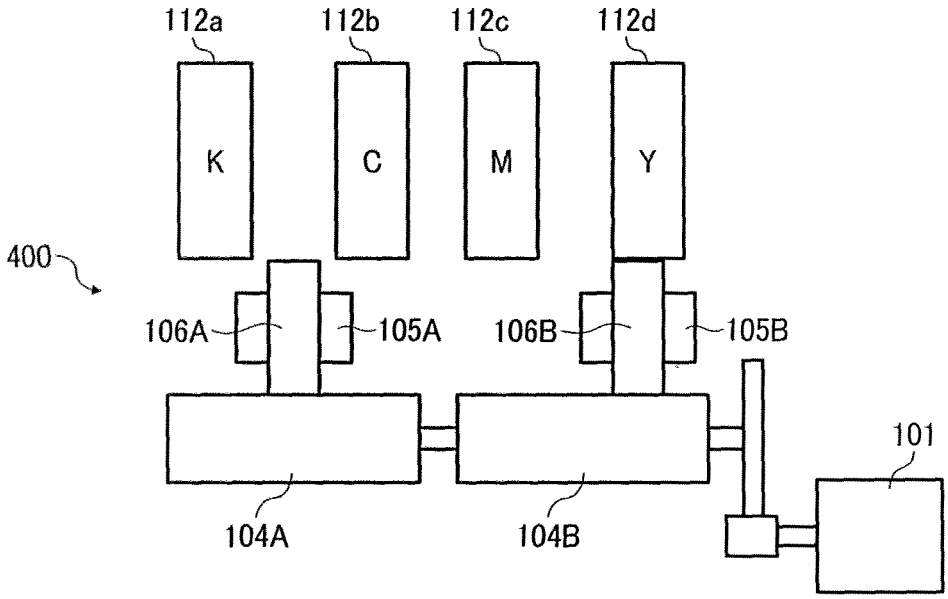
FIG. 12 is a schematic view of a drive switching assembly according to an exemplary embodiment of this disclosure.

FIG. 12 is a schematic view of the drive switching assembly in this exemplary embodiment. FIG. 13 is a schematic view of a cam position detection unit of the drive switching assembly. FIG. 14 shows relations among drive transmission targets, cam positions (cam angles), the number of step pulses from a home position of the second driving source, and detection signals of a switching sensor in this exemplary embodiment.

In this exemplary embodiment, as illustrated in FIG. 12, for the drive switching assembly 400, driving of the driving gears 112*a* and 112*b* is switched by the first switching gear 106A and driving of the driving gears 112*c* and 112*d* is switched by the first switching gear 106B. In addition, in this exemplary embodiment, the driving gear 112*a*, the driving gear 112*b*, the driving gear 112*c*, and the driving gear 112*d* drive the liquid feed pumps dedicated for black, cyan, magenta, and yellow, respectively.

Figure 13:
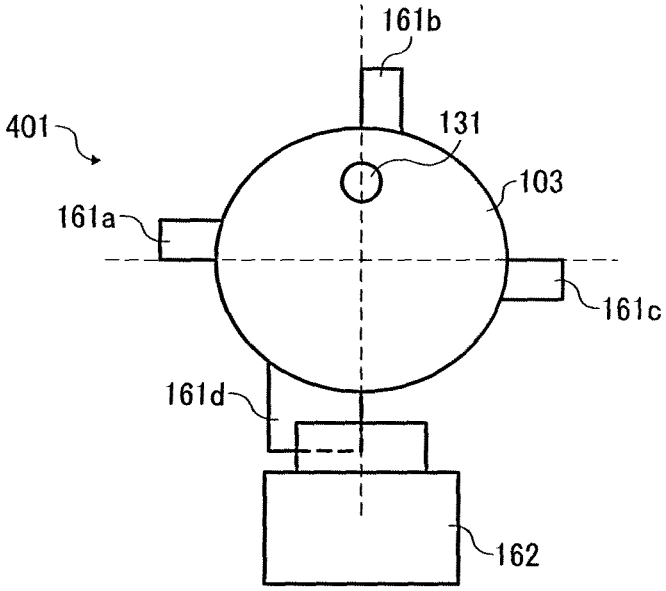
FIG. 13 is a schematic view of a cam position detection unit of the drive switching assembly.

In this exemplary embodiment, as illustrated in FIG. 13, a cam position detection unit 401 is provided to detect the position of a cam 103. For the cam position detection unit 401, four sensor flags 161*a* to 161*d* (referred to as "sensor flags 161" unless distinguished) serving as sensor feelers or switching-position detected portions corresponding to the switching positions of the liquid feed pumps are disposed at the cam 103.

Out of the sensor flags 161*a* to 161*d*, for example, since a sensor flag 161*d* is also used to detect the home position, the sensor flag 161*d* has a greater width in a rotation direction of the cam 103 than the other sensor flags 161*a* to 161*c*.

The cam position detection unit 401 also includes a switching sensor 162 serving as a detector to detect the sensor flags 161. The switching sensor 162 is, e.g., a transmissive photosensor, and outputs a signal indicating a first state ("1" for switching to ON state) while detecting the sensor flags 161 and a signal indicating a second state ("0" for switching to OFF state) while not detecting the sensor flags 161. It is to be noted that the switching sensor 162 may be a mechanical ON/OFF sensor instead of the optical sensor.

As a result, when the cam 103 rotates from the home position (defined as 0°), the switching sensor 162 outputs the signal for switching the OFF state to the ON state when the switching sensor 162 detects the sensor flags 161.

When the output signal of the switching sensor 162 is switched from the OFF state to the ON state, it can be determined that the cam 103 takes a switching position.

Figure 14:
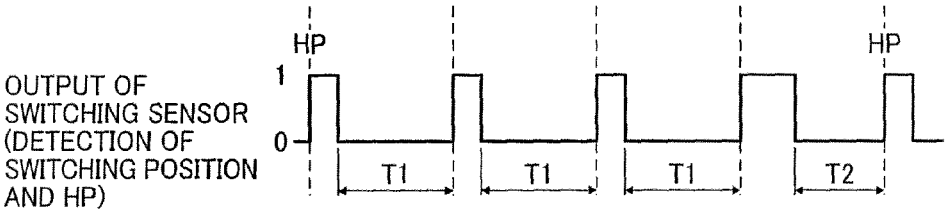
FIG. 14 is a table and chart showing relations among drive transmission targets, cam positions (cam angles), the number of step pulses from a home position of a second driving source, and detection signals of a switching sensor in an example of drive control of a second driving source of the drive switching assembly.

In such a configuration, as illustrated in (a) of FIG. 14, the home position of the cam 103 is defined as 0°. When the rotation angle of the cant 103 is 0° (360°, the first switching gear 106B engages the driving gear 112*c* for magenta to transmit the driving force. When the rotation angle of the cam 103 is 90°, the first switching gear 106A engages the driving gear 112*a* for black to transmit the driving force. When the rotation angle of the cam 103 is 180°, the first switching gear 106A engages the driving gear 112*b* for cyan to transmit the driving force. When the rotation angle of the cam 103 is 270°, the first switching gear 106B engages the driving gear 112*d* for yellow to transmit the driving force.

At this time, if the rotation accuracy of the second driving motor 102 formed of a stepping motor to rotate the cam 103 is set so as to rotate 1° per pulse, as illustrated in (b) of FIG. 14, when the cam 103 takes the home position, the count value of step pulse applied to the second driving motor 102 from the home position is zero.

From the state, by applying 90 step pulses to the second driving motor 102, the cam 103 rotates 90° from the home position. As a result, the first switching gear 106A engages the driving gear 112*a* for black to transmit the driving force. Likewise, by applying 180 step pulses to the second driving motor 102, the first switching gear 106A engages the driving gear 112*b* for cyan to transmit the driving force. By applying 270 step pulses to the second driving motor 102, the first switching gear 106B engages the driving gear 112*c* for magenta to transmit the driving force. By applying 360 step pulses to the second driving motor 102, the first switching gear 106B engages the driving gear 112*c* for magenta to transmit the driving force.

At this time, while the second driving motor 102 is driven according to the above-described theoretical values, the rising edges of detection signals of the switching sensor 162 are counted to confirm the state of the switching sensor 162 at a target stop position.

Here, in this exemplary embodiment, since the sensor flag 161*d* has a greater width in the rotation direction than the other sensor flags 161*a* to 161*c*, as illustrated in (b) of FIG. 14, a transition time of the sensor flag 161*d* in the ON state is relatively long.

In other words, the time intervals (of the OFF state) between the sensor flag 161*a* and the sensor flag 161*b*, between the sensor flag 161*b* and the sensor flag 161*c*, and between the sensor flag 161*c* and the sensor flag 161*d* are a time T1. By contrast, the interval between the sensor flag 161*d* and the sensor flag 161*a* is a time T2 which is shorter than T1.

Hence, the time interval between adjacent sensor flags, in other words, the time period from the trailing edge of a detection signal of the switching sensor 162 to the rising edge of a subsequent detection signal of the switching sensor 162 is measured and compared with a predetermined threshold value (in the above-described example, the time between T1 and T2). If the time interval measured is the threshold value or less, the detection of the subsequent sensor flag is determined as the detection of the home position.

Thus, when the switching sensor 162 detects the sensor flag 161*d*, the detected position of the subsequent sensor flag 161*a* can be determined as the home position.

As described above, in this exemplary embodiment, the detected portions for detection of the switching positions are also used as the detected portions for detection of the home position. Such a configuration obviates a sensor for detecting the home position, thus reducing the cost.

Figure 15:
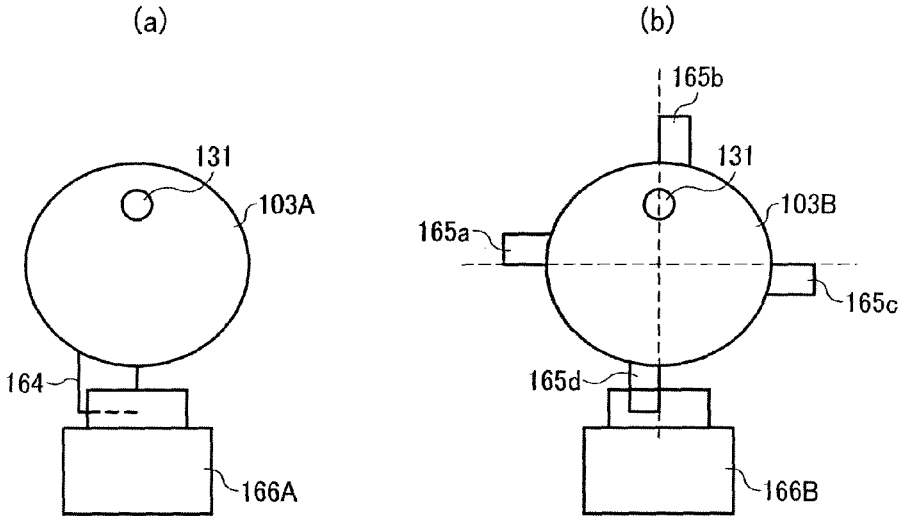
FIG. 15 is a schematic view of a cam position detection unit according to a comparative example.
Figure 16:
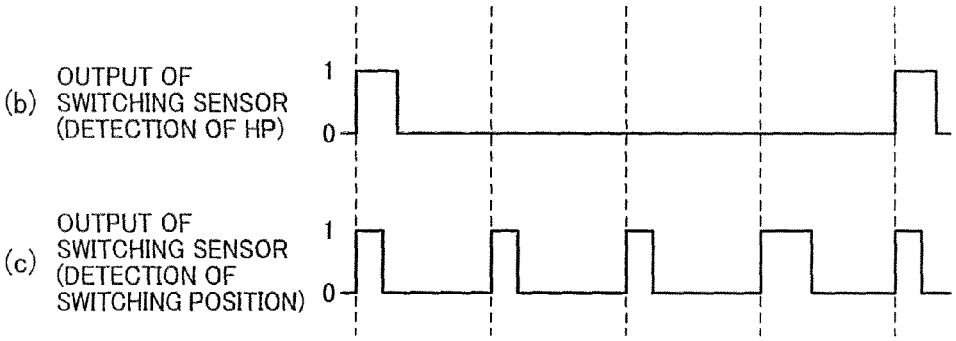
FIG. 16 is a table and chart showing relations among drive transmission targets, cam positions (cam angles), the number of step pulses from a home position of a second driving source, and detection signals of a switching sensor in the comparative example.

By contrast, like a comparative example illustrated in (a) and (b) FIG. 15, for example, it is conceivable that a sensor flag 164 for detection of the home position is provided with a cam 103A and is detected by a home sensor 166A, and sensor flags 165*a* to 165*d* for detection of the switching positions are provided with a cam 103B and detected by a switching sensor 166B. In such a case, as illustrated in FIG. 16, the home sensor 166A and the switching sensor 166B detect the home position and the switching positions, respectively, thus resulting in a relatively complex configuration and an increased cost.

Next, another example of driving control of the second driving source of the drive switching assembly is described with reference to FIG. 17.

Figure 17:
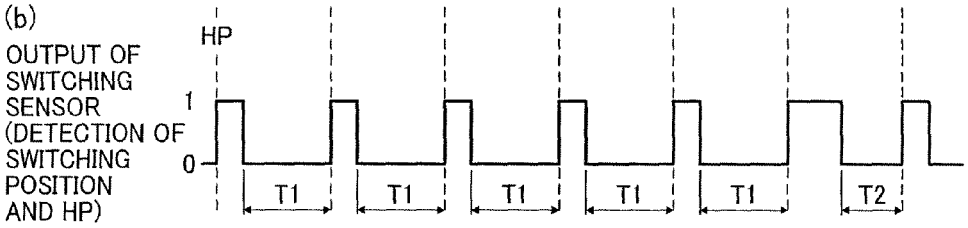
FIG. 17 is a table and chart showing relations among drive transmission targets, cam positions (cam angles), the number of step pulses from a home position of a second driving source, and detection signals of a switching sensor in another example of drive control of the second driving source of the drive switching assembly.

FIG. 17 shows relations among drive transmission targets, cam positions (cam angles), the number of step pulses from a home position of the second driving source, and detection signals of a switching sensor in this exemplary embodiment.

Here, as described with reference to FIG. 8, the driving gears 112*a* to 112*d* corresponding to the four liquid feed pumps, the driving gear 113 of the maintenance unit, and the driving gear 114 of the air release driving pin member are switched by the cams 103A and 103B to selectively transmit the driving force.

Such a configuration allows the home position and the switching position to be detected by a single sensor as in the above-described example.

Next, an image forming apparatus according to a second exemplary embodiment of this disclosure is described with reference to FIGS. 18 to 24.

Figure 18:
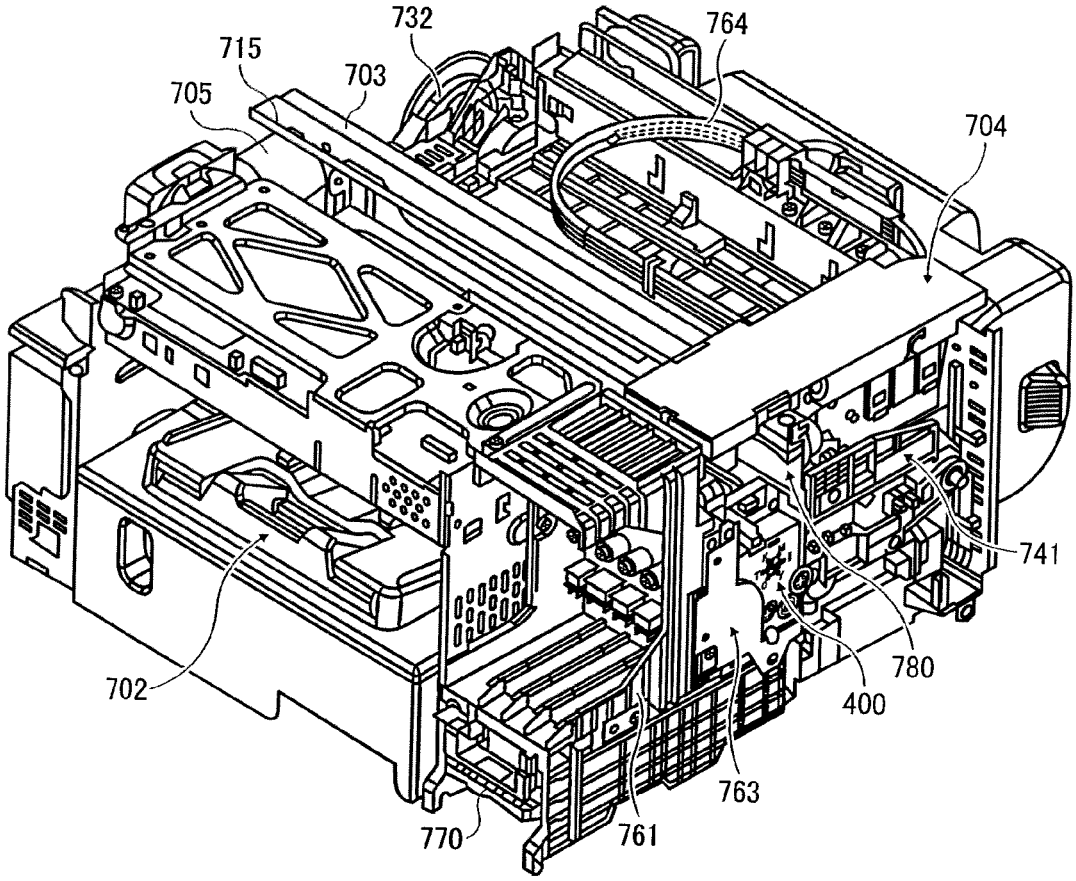
FIG. 18 is a perspective view of a mechanical section of an image forming apparatus according to a second exemplary embodiment of this disclosure.
Figure 19:
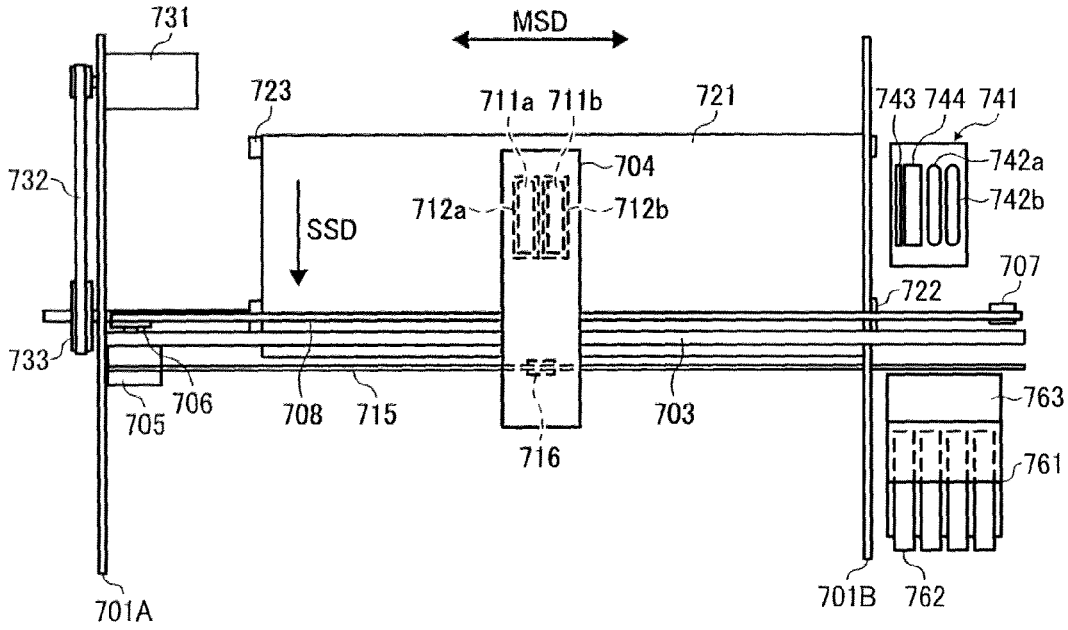
FIG. 19 is a schematic plan view of the mechanical section of the image forming apparatus illustrated in FIG. 18.
Figure 20:
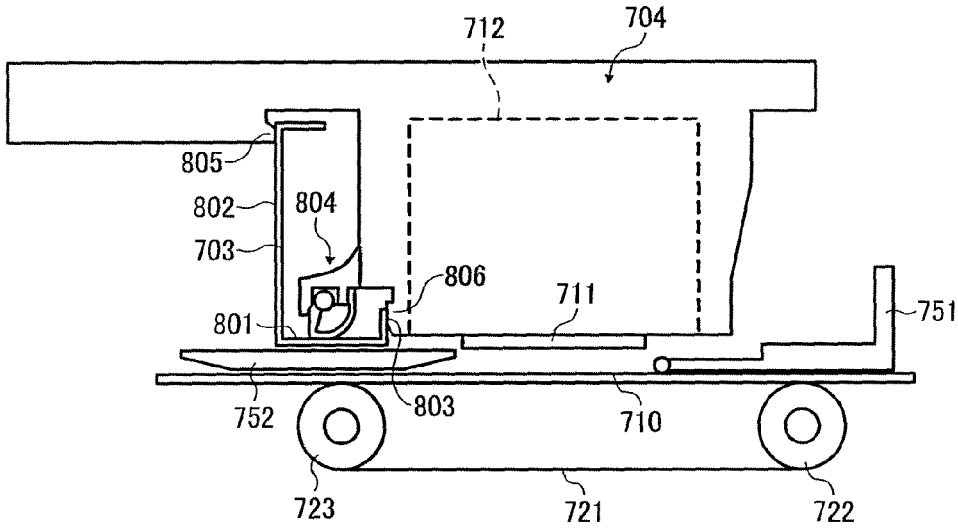
FIG. 20 is a schematic side view of a carriage and its surrounding part of the mechanical section.

FIG. 18 is a perspective view of a mechanical section of the image forming apparatus. FIG. 19 is a partial plan view of the mechanical section. FIG. 20 is a schematic side view of a carriage and its surrounding part of the mechanical section.

The basic configuration of the image forming apparatus according to this exemplary embodiment is substantially the same as the image forming apparatus according to the above-described first exemplary embodiment, and therefore are simply described below.

In this exemplary embodiment, as illustrated in FIG. 18, the image forming apparatus has a sheet feed and output tray 702 mounted in an apparatus body.

As illustrated in FIG. 19, in the mechanical section of the image forming apparatus, a guide member 703 formed of a plate member extends between a left side plate 701A and a right side plate 701B. A carriage 704 is supported by the guide member 703 so as to be reciprocally movable along a main scanning direction indicated by an arrow MSD in FIG. 19. A timing belt 708 is looped under tension between a driving pulley 706 and a driven pulley 707. The carriage 704 is moved for scanning in the main scanning direction MSD by a main scanning motor 705 via the timing belt 708.

As illustrated in FIG. 20, the guide member 703 has guide faces 801, 802, and 803 serving as support faces to movably guide the carriage 704. The carriage 704 has a height adjustment portion 804 movably supported by the guide face 801 of the guide member 703, a contact portion 805 movably contacting the guide face 802, and a contact portion 806 movably contacting the guide face 803. Thus, a so-called rodless type of guide mechanism is employed.

The carriage 704 mounts recording heads 711*a* and 711*b* (collectively referred to as "recording heads 711" unless distinguished) formed of liquid ejection heads serving as image forming devices for ejecting ink droplets of different colors, e.g., yellow (Y), cyan (C), magenta (M), and black (K). The recording heads 711*a* and 711*b* are mounted on the carriage 704 so that nozzle rows, each of which includes multiple nozzles, are arranged in parallel to a direction (sub-scanning direction indicated by an arrow SSD in FIG. 19) perpendicular to the main scanning direction and ink droplets are ejected downward from the nozzles.

Head tanks 712*a* and 712*b* (collectively referred to as "head tanks 712" unless distinguished) are integrally provided with the recording heads 711 to supply ink to the recording heads 711. A cartridge holder 761 serving as a tank mount portion is disposed at the apparatus body. Replaceable ink cartridges (main tanks) 762 are removably mounted in the cartridge holder 761. A liquid feed pump unit 763 supplies ink (liquid) from the ink cartridges 762 to the head tanks 712 via supply tubes 764.

An encoder scale 715 is disposed along the main scanning direction of the carriage 704. An encoder sensor 716 is provided at the carriage 704 to read the encoder scale 715. The encoder scale 715 and the encoder sensor 716 form a linear encoder.

Below the carriage 704 is disposed a conveyance belt 721 serving as a conveyance member to convey a sheet of recording media in the sub-scanning direction SSD. The conveyance belt 721 is looped between a conveyance roller 722 and a tension roller 723. When the conveyance roller 722 is rotated by a sub-scanning motor 731 via a timing belt 732 and a timing pulley 733, the conveyance belt 722 circulates in the sub-scanning direction SSD (belt conveyance direction) illustrated in FIG. 19.

Sheet guide members 751 and 752 are disposed at an entry portion and an exit portion, respectively, of the conveyance belt 721.

At one end side in the main scanning direction of the carriage 704, a maintenance unit (maintenance-and-recovery unit) 741 is disposed near a lateral side of the conveyance belt 721 (outside the side plate 701B). The maintenance unit 741 maintains and recovers nozzle conditions of the recording heads 711. The maintenance unit 741 includes, e.g., a suction cap 742*a*, a moisture-retention cap 742*b*, a wiping member 743, and a dummy ejection receptacle 744. Waste liquid generated by maintenance and recovery operation is discharged to a waste liquid tank 770.

Image forming operation of the image forming apparatus thus configured is substantially the same as that of the image forming apparatus according to the above-described exemplary embodiment, and descriptions thereof are omitted below.

Next, an arrangement of the drive switching assembly 400 in the image forming apparatus according to the second exemplary embodiment is described with reference to FIG. 21.

Figure 21:
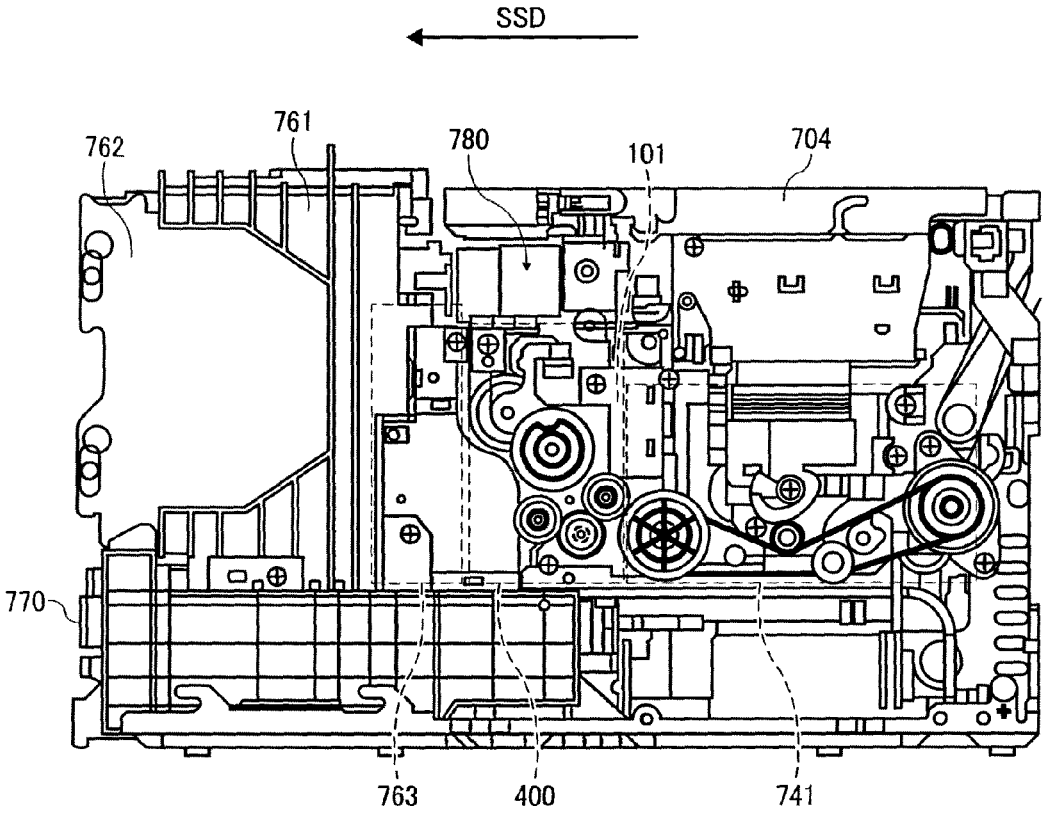
FIG. 21 is a side view of the mechanical section including a drive switching assembly.

FIG. 21 is a side view of the image forming apparatus including the drive switching assembly 400.

As illustrated in FIG. 21, the image forming apparatus includes the carriage 704, a carriage driving assembly 780, a cartridge holder (tank mount portion) 761, the liquid feed pump unit 763, and the maintenance unit 741. The carriage 704 mounts the recording heads 711 and the head tanks 712. The carriage driving assembly 780 includes, e.g., the guide member 703 to guide the carriage 704. The cartridge holder 761 mounts the ink cartridges 762.

The cartridge holder 761, the liquid feed pump unit 763, the carriage driving assembly 780, and the maintenance unit 741 are arranged in this order (from a downstream side to an upstream side) in a direction in which a sheet of recording media is transported. In addition, with respect to the height direction of the apparatus body 701, the carriage 704 and the carriage driving assembly 780 are disposed at positions higher than the liquid feed pump unit 763 and the maintenance unit 741.

The drive switching assembly 400 is disposed between the liquid feed pump unit 763 and the maintenance unit 741 in the transport direction of the sheet and below the carriage driving assembly 780 in the height direction of the apparatus body 701.

As a result, with respect to a cross section perpendicular to the moving direction (main scanning direction) of the carriage 704, the drive switching assembly 400 is surrounded by the liquid feed pump unit 763, the maintenance unit 741, the carriage 704, and the carriage driving assembly 780. Such a configuration provides an efficient arrangement, thus preventing an increase in the size of the apparatus body.

Figure 23:
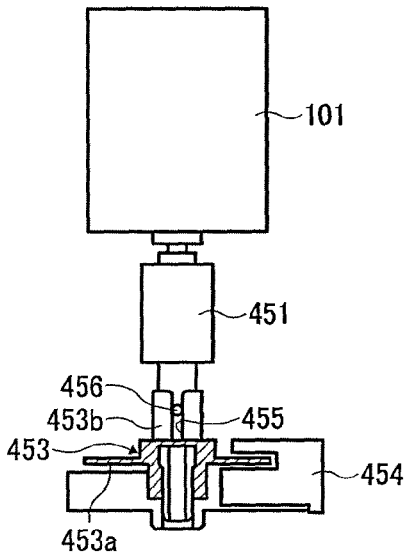
FIG. 23 is a side view of a connecting portion of a first driving motor and an encoder sheet unit of the drive switching assembly.
Figure 24:
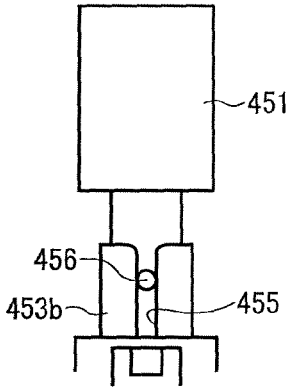
FIG. 24 is a partially enlarged view of the connecting portion of FIG. 23.

Next, a connecting structure of a first driving motor and an encoder sheet unit in the drive switching assembly is described with reference to FIGS. 22 to 24.

Figure 22:
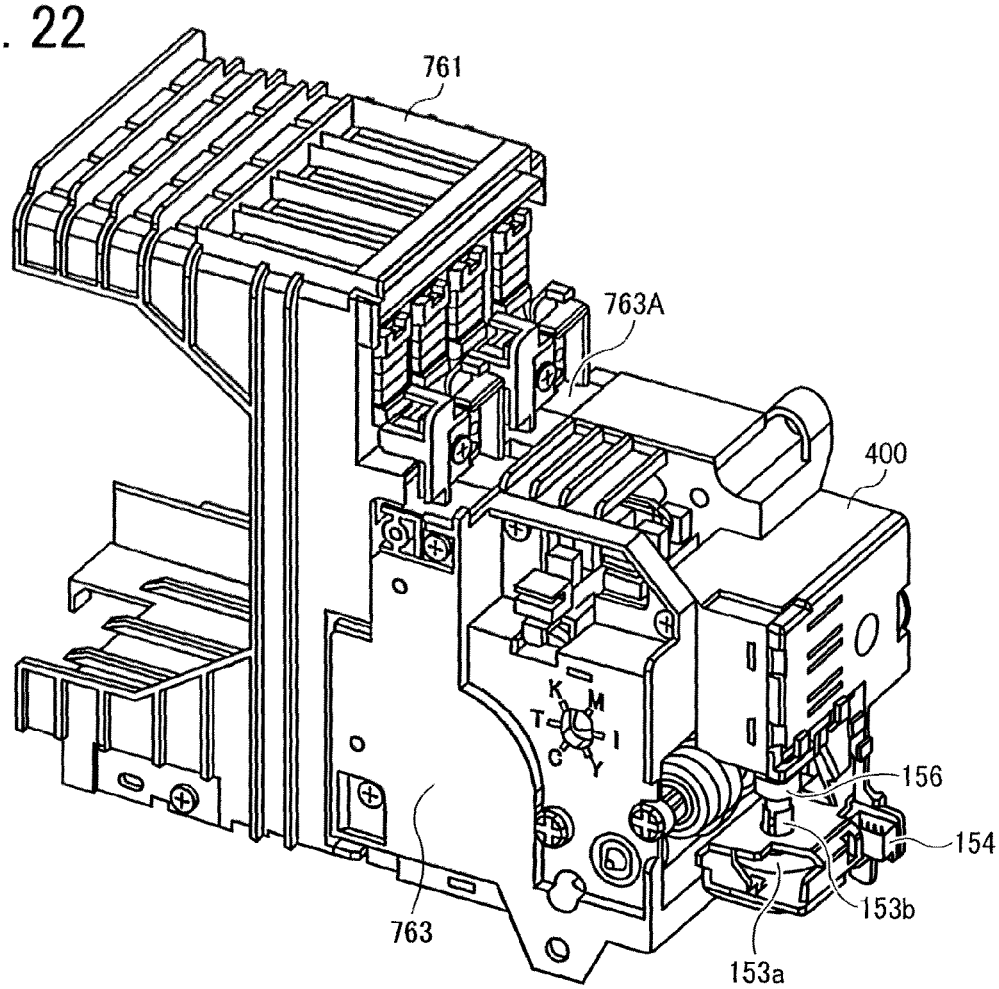
FIG. 22 is a perspective view of the drive switching assembly.

FIG. 22 is a perspective view of the drive switching assembly. FIG. 23 is a side view of a connecting portion of the first driving motor and the encoder sheet unit of the drive switching assembly. FIG. 24 is a partially enlarged view of the connecting portion of FIG. 23.

The drive switching assembly 400 is integrally provided with the cartridge holder 761 and the liquid feed pump unit 763 including liquid feed pumps 763A and mounted in the apparatus body as a single unit. In the drive switching assembly 400, a first driving motor (first driving source) 101 is disposed at a side opposite the cartridge holder 761 via the liquid feed pump unit 763. A driving gear 451 is mounted on a rotation shaft of the first driving motor 101. An encoder sheet unit 453 is connected to the driving gear 451 to detect the rotation amount of the first driving motor 101. An encoder sensor 454 is disposed to read an encoder sheet 453*a*.

A shaft member 453*b* holds the encoder sheet 453*a* of the encoder sheet unit 453 and has a groove 455 formed along the axial direction. The driving gear 451 has a pin member 456 to engage the groove 455.

The driving gear 451 is movable in a thrust direction relative to the encoder sheet unit 453 and is connected to the encoder sheet unit 453 in a state in which the encoder sheet unit 453 is rotatable with the rotation of the driving gear 451.

As a result, even if the rotation shaft of the first driving motor 101 or the driving gear 451 fluctuates up and down, the encoder sheet unit 453 does not move up and down. Such a configuration can transmit only the rotation force of the first driving source to the encoder sheet unit 453 while preventing the encoder sheet 453*a* from rubbing against the encoder sensor 454.

Next, an image forming apparatus according to a third exemplary embodiment of this disclosure is described with reference to FIGS. 25 and 26.

Figure 25:
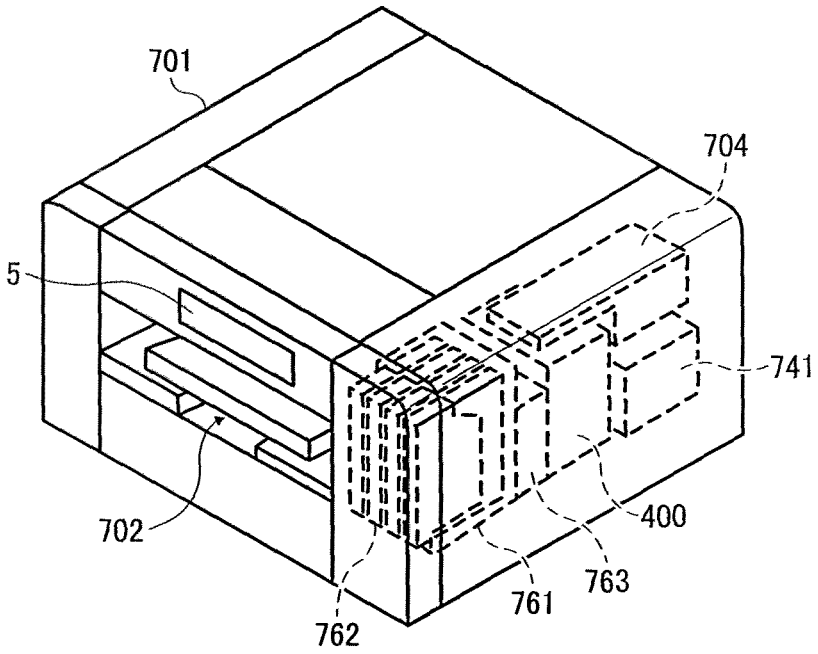
FIG. 25 is an external perspective view of an image forming apparatus according to a third exemplary embodiment of this disclosure.

FIG. 25 is an external perspective view of the image forming apparatus according to the third exemplary embodiment. FIG. 26 is a side view of a drive switching assembly and its surrounding part of the image forming apparatus.

The same reference numbers are allocated to elements and components corresponding to those of the image forming apparatus according to the second exemplary embodiment.

For the image forming apparatus, a sheet feed and output tray 702 is removably mounted at a front face side of an apparatus body 701. In the sheet feed and output tray 702, a sheet feed tray to load sheets and a sheet output tray to stack sheets having images formed thereon are integrally formed as a single unit. At an upper portion of the front face of the apparatus body 701 is disposed an operation-and-indication unit 5 including, e.g., operations buttons and indicators.

Inside the apparatus body 701, the image forming apparatus according to the third exemplary embodiment has a mechanical section similar to that of the image forming apparatus according to the second exemplary embodiment illustrated in FIG. 21. The image forming apparatus includes a carriage 704, a carriage driving assembly 780, a cartridge holder (tank mount portion) 761, a liquid feed pump unit 763, a drive switching assembly 400, and a maintenance unit 741. The carriage 704 mounts recording heads 711 and head tanks 712. The carriage driving assembly 780 includes, e.g., a guide member 703 to guide the carriage 704. Ink cartridges 762 are removably mountable to the cartridge holder 761.

Figure 26:
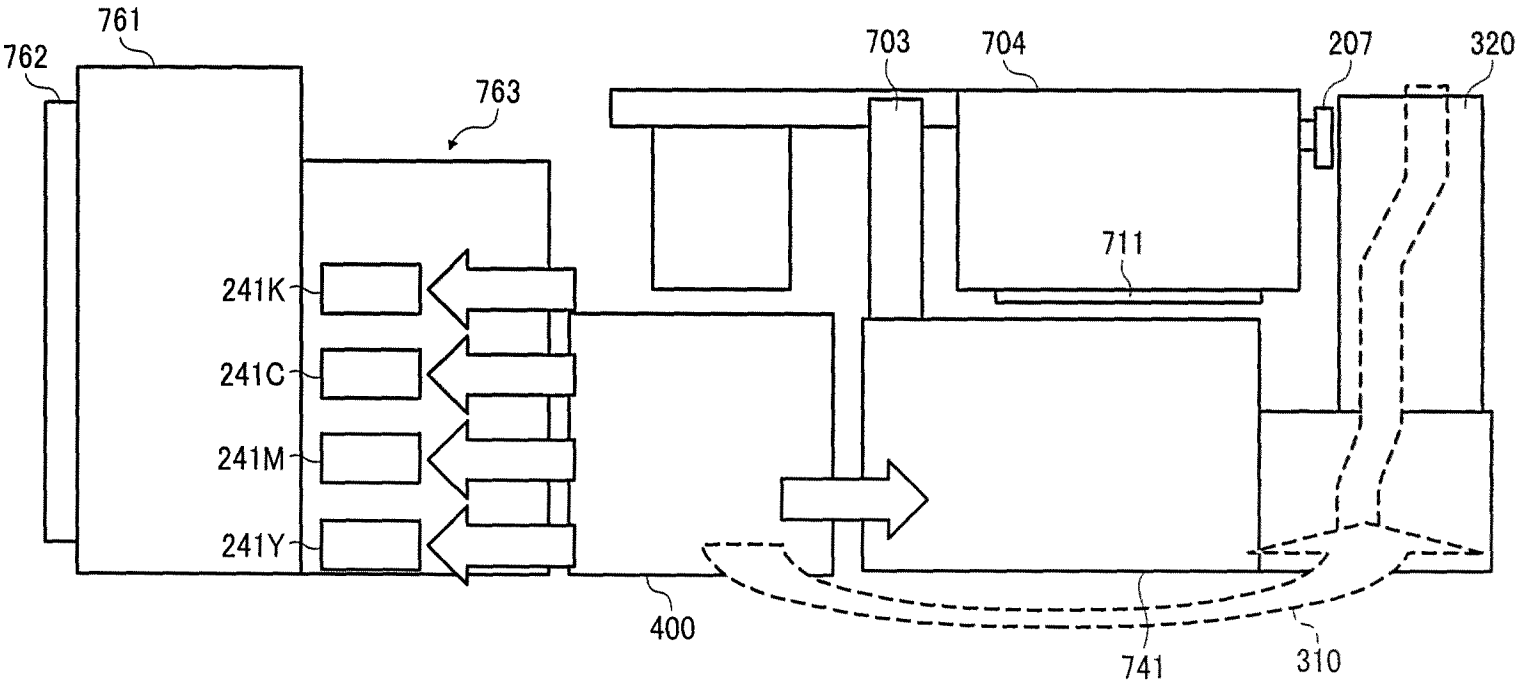
FIG. 26 is a schematic view of a drive switching assembly and its surrounding part of the image forming apparatus according to the third exemplary embodiment.

As illustrated in FIG. 26, similarly with the image forming apparatus according to the second exemplary embodiment, the cartridge holder 761, the liquid feed pump unit 763, the carriage driving assembly 780, and the maintenance unit 741 are arranged in this order (from a downstream side to an upstream side) in a direction (transport direction) in which a sheet of recording media is transported. In addition, with respect to the height direction of the apparatus body 701, the carriage 704 and the carriage driving assembly 780 are disposed at positions higher than the liquid feed pump unit 763 and the maintenance unit 741.

The drive switching assembly 400 is disposed between the liquid feed pump unit 763 and the maintenance unit 741 in the transport direction of the sheet and below the carriage driving assembly 780 in the height direction of the apparatus body 701.

In addition, the driving force of the drive switching assembly 400 is transmitted to an air release driving pin member to open an air release unit 207 of the head tank 712 via a driving-force transmission assembly 310 for air release bypassing below the maintenance unit 741.

In other words, in this exemplary embodiment, for example, the carriage 704 and the guide member 703 are disposed near the drive switching assembly 400, liquid feed pumps 241 of the liquid feed pump unit 763 driven via the drive switching assembly 400, and the maintenance unit 741.

As a result, there is little space for an air release driving unit to drive the air release unit 207 of the head tanks 712.

Hence, in this exemplary embodiment, the air release unit 207 is activated by the driving-force transmission assembly 310 serving as a link mechanism disposed so as to bypass the maintenance unit 741.

Here, the driving-force transmission assembly 310 is described with reference to FIG. 27.

Figure 27:
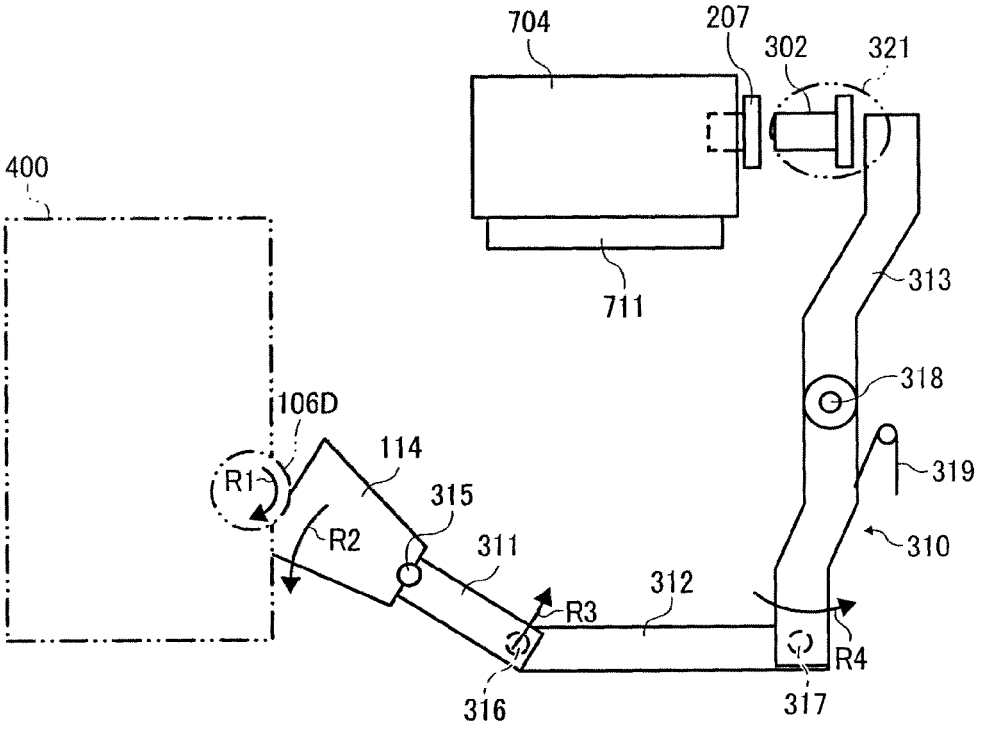
FIG. 27 is a schematic view of a configuration of a driving-force transmission assembly for air release of the image forming apparatus according to the third exemplary embodiment.

FIG. 27 is a schematic view of a configuration of the driving-force transmission assembly 310 for air release.

In FIG. 27, the same reference codes as in the first exemplary embodiment are allocated to elements and components of the head tank 712 relating to air release operation.

The driving-force transmission assembly 310 is a link mechanism including a link member 311, an intermediate link member 312, and an air release lever 313. A driving gear 114 is integrally formed at one end portion of the link member 311 to engage a switching gear (hereinafter, "idler gear") 106D. The air release lever 313 pushes an air release driving pin member 302 to open the air release unit 207 of the head tanks 712.

The link member 311 is swingably supported by a shaft member 315. The air release lever 313 is swingably supported by a shaft member 318 and urged by a spring 319 in a direction to separate away from the air release driving pin member 302. The link member 311 and the intermediate link member 312 are swingably connected to each other. The intermediate link member 312 and the air release lever 313 are swingably connected to each other One end portion of the air release lever 313 is disposed at a rear face side of the air release driving pin member 302. The air release driving pin member 302 is held by a bracket 320 via a latch unit 321. The latch unit 321 has a mechanism for advancing and retreating the air release driving pin member 302 when the air release driving pin member 302 is pushed by the air release lever 313. It is to be noted that the latch unit 321 may be disposed at the carriage 704.

In such a configuration, in FIG. 27, for example, when the idler gear 106D of the drive switching assembly 400 rotates in a direction indicated by an arrow R1, the driving gear 114 and the link member 311 swing in directions indicated by arrow R2 and R3, respectively. The air release lever 313 swings in a direction indicated by an arrow R4 via the intermediate link member 312 to press the air release driving pin member 302. As a result, the air release unit 207 of the head tank 712 is turned into air release state.

For the image forming apparatus, in sequence, the liquid feed pump unit 763 or the maintenance unit 741 is activated with the air release unit 207 of the head tank 712 being in air release state. Hence, by rotating the first driving motor 101 in reverse, the air release lever 313 returns to a state illustrated in FIG. 27. By contrast, the air release driving pin member 302 is held at the same state by the latch unit, and the air release unit 207 of the head tank 712 is held at the air release state.

Then, the air release lever 313 is driven to swing in the direction R4 again. As a result, the air release driving pin member 302 is pressed by the air release lever 313 to close the air release unit 207.

Figure 29:
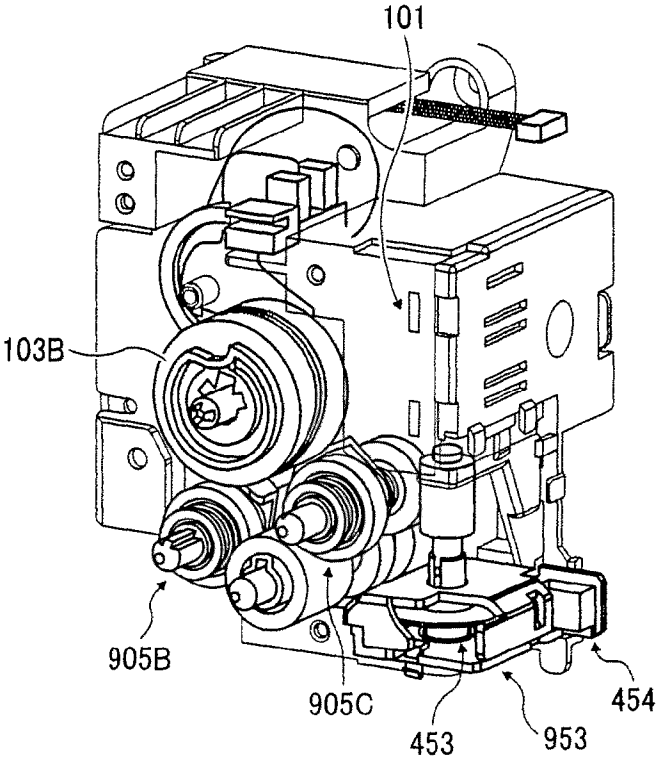
FIG. 29 is a perspective view of the drive switching assembly seen from a back right side of the apparatus body.

Next, a configuration of the drive switching assembly in the image forming apparatus according to the third exemplary embodiment is described with reference to FIGS. 28 and 29.

Figure 28:
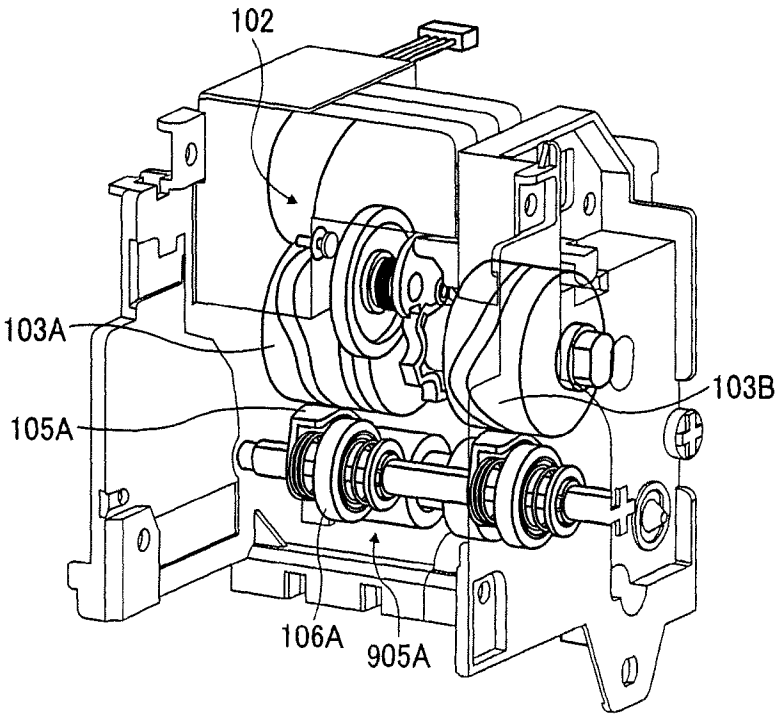
FIG. 28 is a perspective view of the drive switching assembly seen from a front right side of an apparatus body of the image forming apparatus according to the third exemplary embodiment.

FIG. 28 is a perspective view of the drive switching assembly seen from a front right side of the apparatus body. FIG. 29 is a perspective view of the drive switching assembly seen from a back right side of the apparatus body.

The drive switching assembly 400 of the image forming apparatus according to the third exemplary embodiment has substantially the same configuration as the drive switching assembly 400 of each of the above-described exemplary embodiments. In other words, the drive switching assembly 400 includes, for example, a switching motor (switching drive source or second driving motor) 102, a switching sensor 162, switching cams 103A and 103B, slider units 905A to 905D, a first driving motor 101, and an encoder 953. Each of the slider units 905A to 905D (collectively referred to as "slider units 905" unless distinguished) has one of slider members 105A to 105D and one of idler gears (swinging gears) 106A to 106D as a single unit. The encoder 953 includes an encoder sheet unit 453 and an encoder sensor 454.

Figure 31:
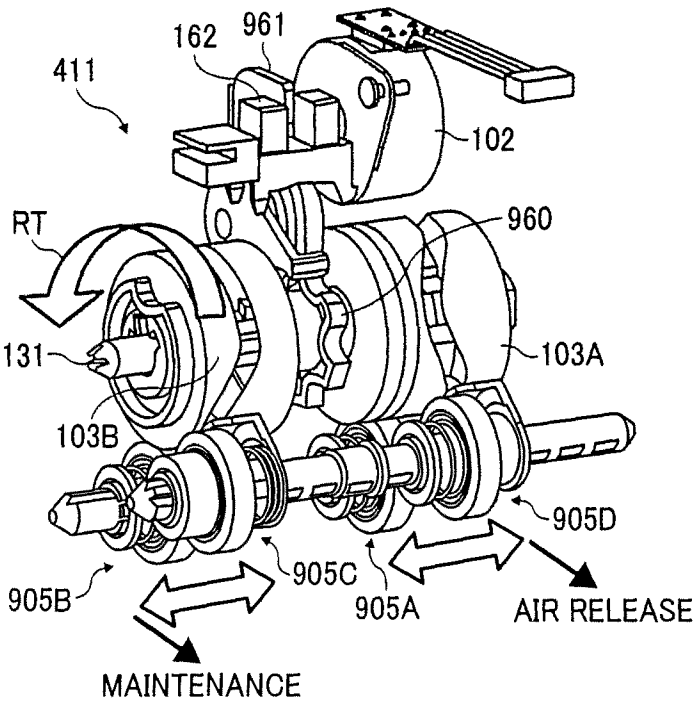
FIG. 31 is a perspective view of the drive switching unit seen from a back right side of the apparatus body.

Next, a drive switching unit of the drive switching assembly in the third exemplary embodiment is described with reference to FIGS. 30 and 31.

Figure 30:
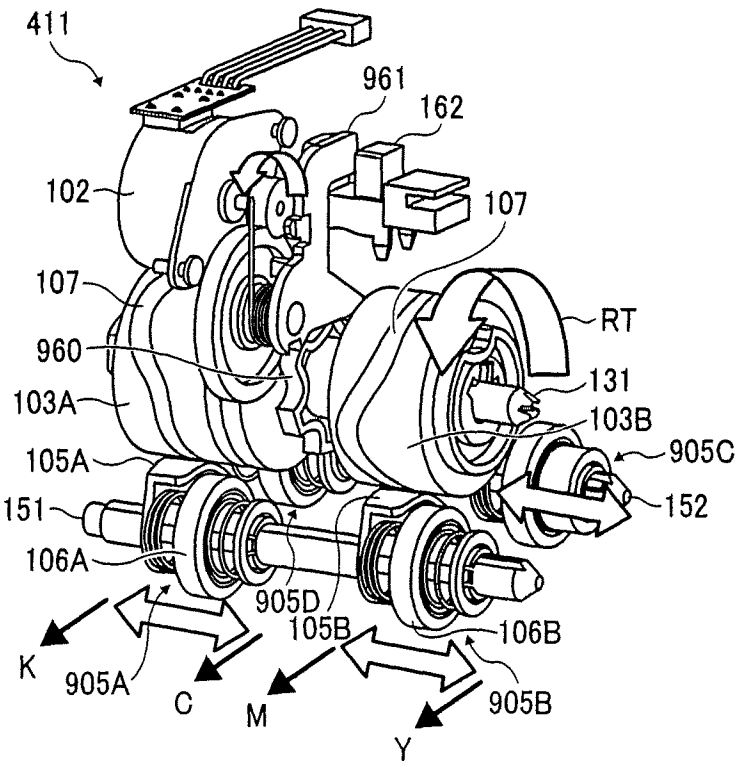
FIG. 30 is a perspective view of a drive switching unit of the drive switching assembly seen from a front right side of the apparatus body.

FIG. 30 is a perspective view of the drive switching unit seen from a front right side of the apparatus body. FIG. 31 is a perspective view of the drive switching unit seen from a back right side of the apparatus body.

The drive switching assembly 400 includes a drive switching unit 411 and a drive transmission unit 412.

In the drive switching unit 411, when the switching cams 103 are rotated by rotation of the second driving motor 102 serving as a switching motor, the slider units 905 move in thrust directions and the idler gears 106 engage gears of drive transmission targets in turn.

For example, drive transmission targets of the idler gear 106A are the liquid feed pump 241K for black (K pump) and the liquid feed pump 241C for cyan (C pump). Drive transmission targets of the idler gear 106B are the liquid feed pump 241M for magenta (M pump) and the liquid feed pump 241Y for yellow (Y pump). A drive transmission target of the idler gear 106C is the maintenance unit 741. A drive transmission target of the idler gear 106D is the driving-force transmission assembly 310 for air release. In FIGS. 30 and 31, the positional relation of the idler gears 106C and 106D are opposite to the positional relation thereof illustrated in FIG. 9.

Similarly with the configuration described with reference to FIG. 17, each time the switching cams 103 rotate at a rotation angle of 60° in a rotation direction indicated by an arrow RT in FIGS. 30 and 31 from a reference position of the switching sensor 162, the drive transmission targets of the switching cams 103 are switched one by one cyclically in an order from the maintenance unit 741, the liquid feed pump 241M for magenta, the liquid feed pump 241K for black, the driving-force transmission assembly 310 for air-release, the liquid feed pump 241C for cyan, and the liquid feed pump 241Y for yellow.

Figure 32:
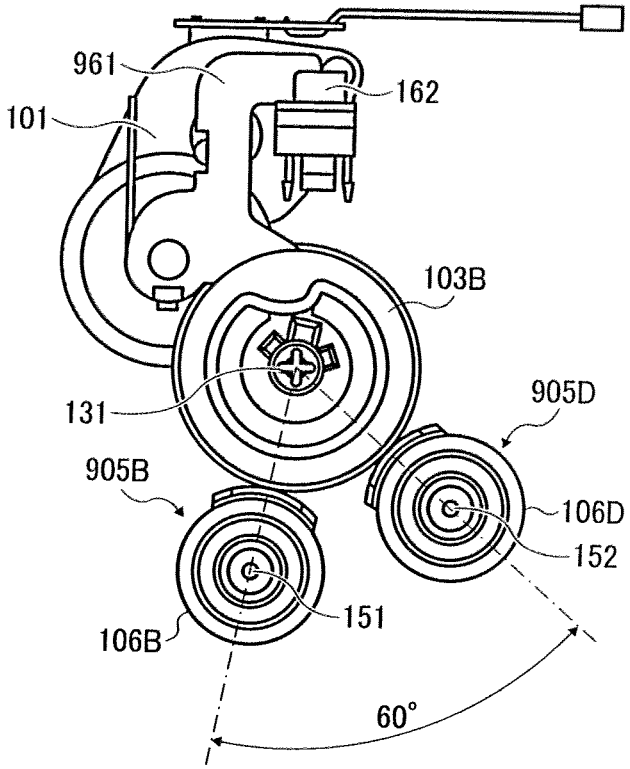
FIG. 32 is a side view of the drive switching unit of FIG. 31.

In the drive switching assembly 400, two switching targets (drive transmission targets) are selected by each of the slider units 905A and 905B. As illustrated in FIG. 32, two slider units 905 (905B and 905D in FIG. 32) are disposed at front and rear sides of one (103B in FIG. 32) of the switching cams 103 to form an angle of 60°, which is the same as the rotation angle of the switching cam 103, between a line connecting a support shaft 131 of the switching cam 103 to a support shaft 151 of one (106B in FIG. 32) of the idler gears 106 and a line connecting the support shaft 131 of the switching cam 103 to a support shaft 152 of the other (106D in FIG. 32) of the idler gears 106 in a cross section illustrated in FIG. 32

As described above, using a common cam for a plurality of slider units can minimize the number of components, thus reducing the size of the drive switching unit.

Next, a configuration of the slider unit is described with reference to FIGS. 33 and 34.

Figure 33:
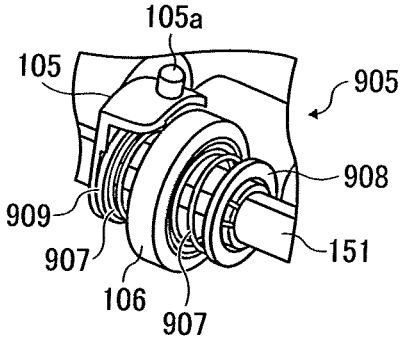
FIG. 33 is a perspective view of a slider unit of the drive switching unit.

FIG. 33 is a perspective view of a configuration of the slider unit. FIG. 34 shows operation states of the slider unit.

The idler (swinging) gear 106 of the slider unit 905 movably engages the slider member 105. Both sides of the idler gear 106 are held by springs 907 disposed between flange members 908 and 909 and both sides of the idler gear 106.

The flanges 908 and 909 are held relative to the idler gear 106 in a state in which a maximum separation range between the idler gear 106 and each of the flange members 908 and 909 is regulated by each of bridge portions 910. The flange members 908 and 909 are movable in a direction to approach the idler gear 106.

Figure 34:
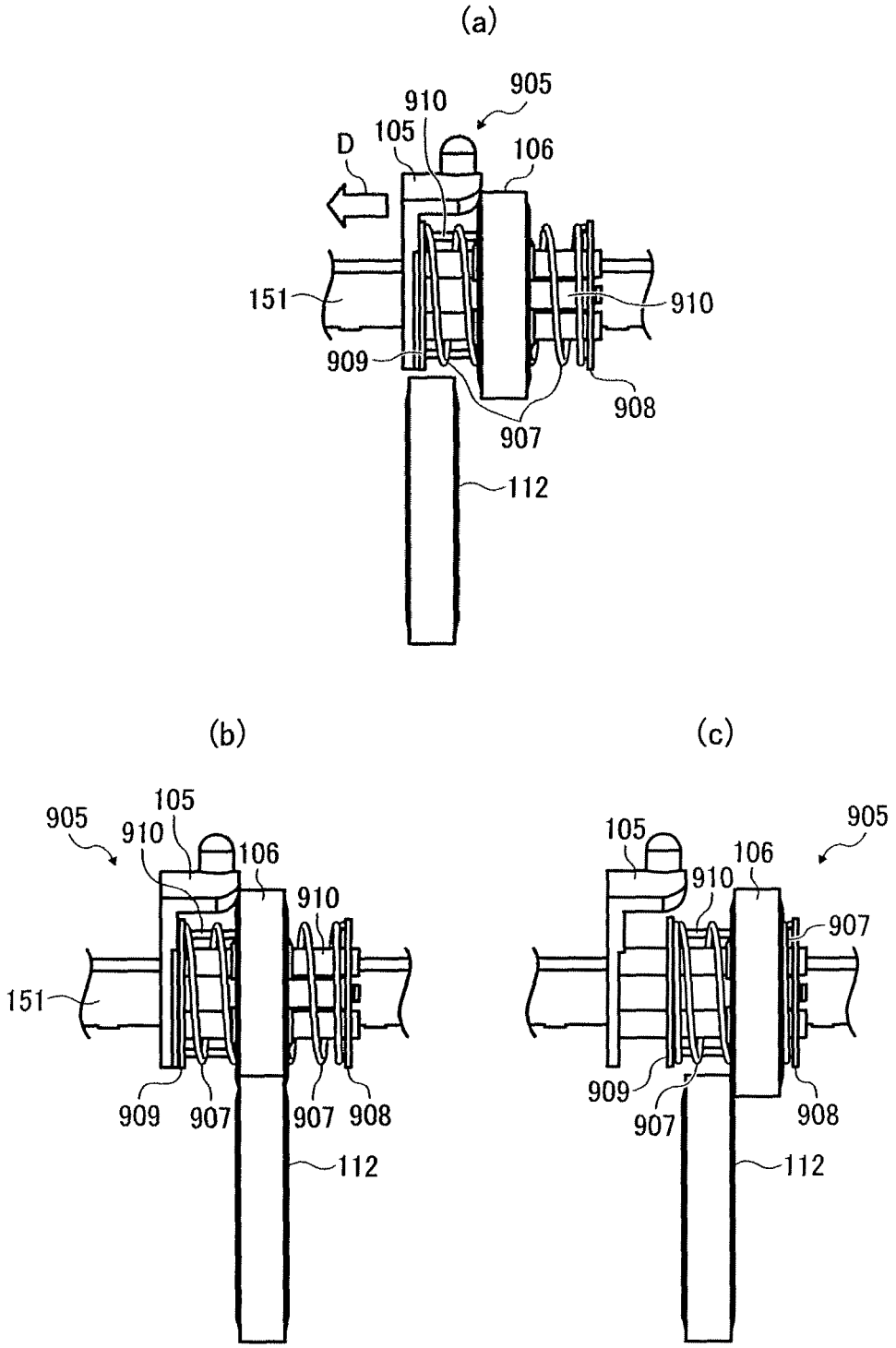
FIG. 34 shows operation states of the slider unit.

For such a configuration, when the slider member 105 moves in a direction indicated by an arrow D from an initial state illustrated in (a) of FIG. 34, if teeth of the idler gear 106 match grooves of a gear 112 of a drive transmission target, as illustrated in (b) of FIG. 34, the idler gear 106 smoothly engages the gear 112 of the drive transmission target.

By contrast, as illustrated in (c) of FIG. 34, a side face of the teeth of the idler gear 106 may conflict a side face of the teeth of the gear 112 of the drive transmission target. At this lime, in this exemplary embodiment, since the idler gear 106 is held by the springs 907, the idler gear 106 can temporarily escape by compression of one of the springs 907. As a result, the idler gear 106 rotates and the teeth of the idler gear 106 match the gear 112 of the drive transmission target. The idler gear 106 is moved back by the restoration force of the compressed spring 907 and normally engages the gear 112 as illustrated in (h) of FIG. 34.

Next, detection of a home position of the switching cam and detection of switching positions in the drive switching assembly are described with reference to FIG. 35.

Figure 35:
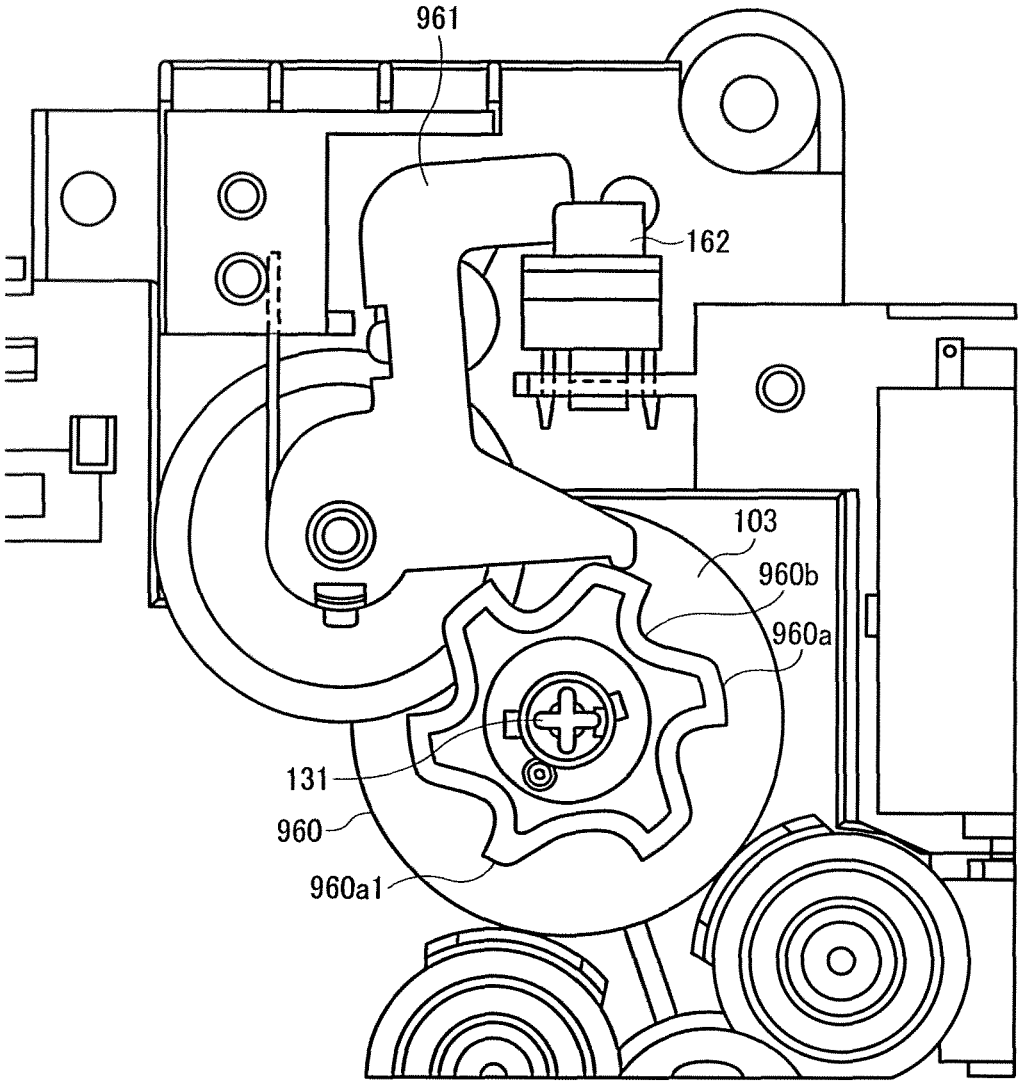
FIG. 35 is a side view of the drive switching assembly in the third exemplary embodiment to show a configuration of detecting a home position and switching positions of a switching cam.

FIG. 35 is a side view of the drive switching assembly in the third exemplary embodiment.

For the above-described cam position detection unit 401 of FIG. 13, the sensor flags 161 are disposed at the cam 103. By contrast, the cam position detection unit 401 in this exemplary embodiment employs a sensor cam 960 serving as a rotary member rotatable with the cam 103 and a sensor feeler (lever) 961 swingable with rotation of the sensor cam 960.

The sensor cam 960 has convex portions (off-shape portions) 960*a* to turn the switching sensor 162 to OFF state (a state in which the switching sensor 162 does not detect the sensor feeler 961) and concave portions (on-shape portions) 960*b* to turn the switching sensor 162 to ON state (a state in which the switching sensor 162 detects the sensor feeler 961). In FIG. 35, for example, the convex portions 960*a* and the concave portions 960*b* are alternately formed at six positions.

As a result, as described above, each time the switching cam 103 rotates 60°, the switching sensor 162 turns into ON state, thus switching the drive transmission targets one by one.

When the drive transmission targets are switched, the number of times the switching sensor 162 turns into ON state is counted and compared with a theoretically required number of times, thus allowing reliable determination of the switching positions.

As illustrated in FIG. 35, in the sensor cam 960, one convex portion 960*a*1 of the convex portions 960*a* has a shorter width in the rotation direction than the others of the convex portions 960*a*. As a result, when the sensor feeler 961 is placed on the convex portion 960*a*1, the time during which the switching sensor 162 is in OFF state is shorter than when the sensor feeler 961 is placed on the others of the convex portions 960*a*.

A position of the switching cam 103 at which the switching sensor 162 turns into ON state immediately after the shorter time of OFF state is determined as the home position of the switching cam 103 (similarly with FIG. 17).

Figure 37:
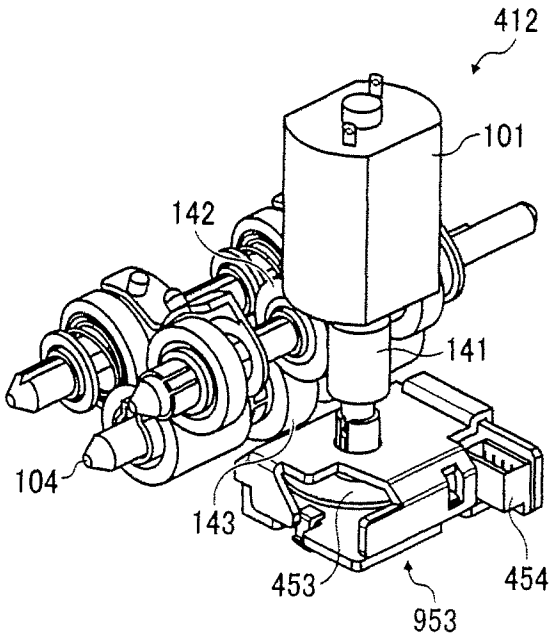
FIG. 37 is a perspective view of the drive transmission unit seen from a back right side of the apparatus body.

Next, a configuration of the drive transmission unit of the drive switching assembly in the third exemplary embodiment is described with reference to FIGS. 36 and 37.

Figure 36:
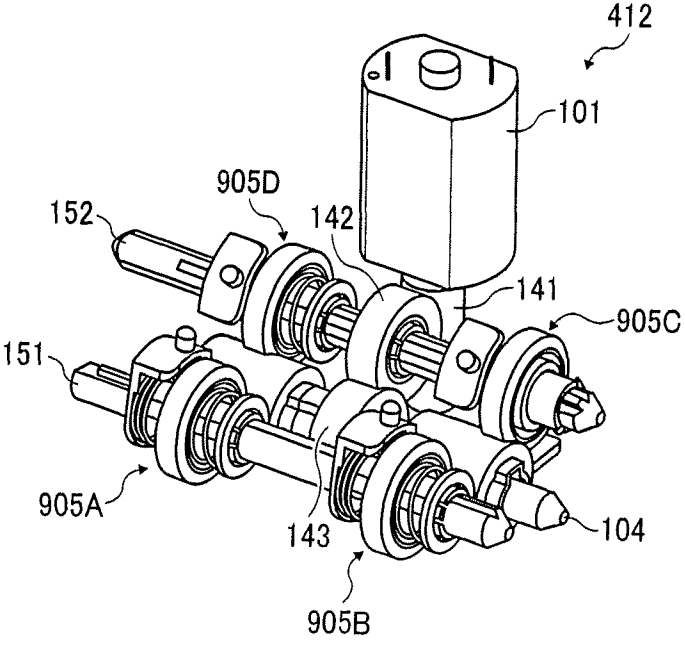
FIG. 36 is a perspective view of a drive transmission unit of the drive switching assembly seen from a front right side of the apparatus body.

FIG. 36 is a perspective view of the drive transmission unit seen from a front right side of the apparatus body. FIG. 37 is a perspective view of the drive transmission unit seen from a back right side of the apparatus body.

The drive transmission unit 412 of the drive switching assembly 400 has a direct current (DC) motor as the first driving motor 101 and performs pulse width modulation (PWM) control to control driving of the first driving motor 101. Similarly with the drive transmission route described with reference to FIGS. 9 to 11 the drive force of the first driving motor 101 is transmitted via the motor gear 141, the gear 142 (rotatably mounted on the support shaft), the gear 143 (rotated by the first driving motor 101), and a driving shaft 104 in this order.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an apparatus body;

a recording head to eject droplets of liquids;

a plurality of head tanks to supply the liquids to the recording head;

a plurality of main tanks removably mounted in the apparatus body to store the liquids to be supplied to the recording head;

a plurality of liquid feed pumps to feed the liquids from the plurality of main tanks to the plurality of head tanks and in reverse from the plurality of head tanks to the plurality of main tanks;

a first driving source to drive the plurality of liquid feed pumps;

a drive control unit to control driving of the first driving source; and a drive switching assembly to selectively transmit a driving force of the first driving source to the plurality of liquid feed pumps, the drive switching assembly including a second driving source controlled by the drive control unit, a cam rotated by the second driving source, a slider member movable in a thrust direction with rotation of the cam, a switching gear to receive the driving force of the first driving source and movable with the slider member between positions to engage driving gears of the plurality of liquid feed pumps and a position to disengage from the driving gears of the plurality of liquid feed pumps, wherein, with movement of the switching gear, the driving force of the first driving source is selectively transmitted to the plurality of liquid feed pumps, a plurality of switching position detected portions disposed at the cam so as to correspond to switching positions of the plurality of liquid feed pumps, one of the plurality of switching position detected portions having a greater width in a rotation direction of the cam than a width of any of the others of the plurality of switching position detected portions; and a detector to detect the plurality of switching position detected portions, wherein, when a time from when the detector detects one of the plurality of switching position detected portions to when the detector detects another one of the plurality of switching position detected portions is shorter than a threshold value, the e control unit determines a home position, a position of the earn on detection of the another one of the plurality of switching position detected portions with the detector.

2. The image forming apparatus of claim 1, further comprising a maintenance unit to maintain and recover the recording head, the maintenance unit including a cap member to cover a nozzle face of the recording head, and a suction pump connected to the cap member to suck the liquid from the recording head, wherein the drive switching assembly includes a second switching gear to receive the driving force of the first driving source and movable with the slider member between a position to engage a driving gear of the maintenance unit and a position to disengage from the driving gear of the maintenance unit.

3. The image forming apparatus of claim 1, further comprising:

an air release unit openably disposed at each of the plurality of head tanks to release air from an interior of the each of the plurality of head tanks to atmosphere; and an air release driving unit disposed at the apparatus body to drive the air release unit, wherein the drive switching assembly includes a second switching gear to receive the driving force of the first driving source and movable with the slider member between a position to engage a driving gear of the air release unit and a position to disengage from the driving gear of the air release unit.

4. The image forming apparatus of claim 1, further comprising:

a carriage mounting the recording head and the plurality of head tanks;

a carriage driving assembly to move the carriage;

a tank mount portion to mount the plurality of main tanks;

a liquid feed pump unit including the plurality of liquid feed pumps; and a maintenance unit to maintain and recover the recording head, wherein the tank mount portion, the liquid feed pump unit, the carriage driving assembly, and the maintenance unit are arranged in order along a transport direction of a recording medium on which an image is formed by the recording head, the carriage and the carriage driving assembly are disposed at positions higher than the liquid feed pump unit and the maintenance unit in a height direction of the apparatus body, and the drive switching assembly is disposed between the liquid feed pump unit and the maintenance unit in the transport direction of the recording medium and below the carriage driving assembly in the height direction of the apparatus body.

5. The image forming apparatus of claim 1, further comprising:

an encoder sheet connected to a rotation shaft of the first driving source or a driving gear rotated with the rotation shaft of the first driving source to detect a rotation amount of the first driving source; and an encoder sensor to detect the encoder sheet, wherein the rotation shaft of the first driving source or the driving gear rotated with the rotation shaft of the first driving source is connected to the encoder sheet so as to be movable in a thrust direction relative to the encoder sheet.

6. An image forming apparatus comprising:

an apparatus body;

a recording head to eject droplets of liquids;

a plurality of head tanks to supply the liquids to the recording head;

a plurality of main tanks removably mounted in the apparatus body to store the liquids to be supplied to the recording head;

a plurality of liquid feed pumps to feed the liquids from the plurality of main tanks to the plurality of head tanks and in reverse from the plurality of head tanks to the plurality of main tanks;

a first driving source to drive the plurality of liquid feed pumps;

a drive control unit to control driving of the first driving source; and a drive switching assembly to selectively transmit a driving force of the first driving source to the plurality of liquid feed pumps, the drive switching assembly including a second driving source controlled by the drive control unit, a cam rotated by the second driving source, a rotary member rotatable with the cam;

a slider member movable in a thrust direction with rotation of the cam, a switching gear to receive the driving force of the first driving source and movable with the slider member between positions to engage driving gears of the plurality of liquid feed pumps and a position to disengage from the driving gears of the plurality of liquid feed pumps, wherein, with movement of the switching gear, the driving force of the first driving source is selectively transmitted to the plurality of liquid feed pumps, a plurality of switching position detected portions disposed at the rotary member so as to correspond to switching positions of the plurality of liquid feed pumps, one of the plurality of switching position detected portions having a greater width in a rotation direction of the rotary member than a width of any of the others of the plurality of switching position detected portions; and a detector to detect the plurality of switching position detected portions, wherein, when a time from when the detector detects one of the plurality of switching position detected portions to when the detector detects another one of the plurality of switching position detected portions is shorter than a threshold value, the drive control unit determines, as a home position, a position of the cam on detection of the another one of the plurality of switching position detected portions with the detector.

* * * * *